US010865066B2

(12) United States Patent
Hayashi

(10) Patent No.: US 10,865,066 B2
(45) Date of Patent: Dec. 15, 2020

(54) SHEET DISCHARGING DEVICE INCLUDING PINCH ROLLER MOVABLE RELATIVE TO DRIVE ROLLER, AND GUIDE MEMBER FOR GUIDING SHEETS

(71) Applicant: Brother Kogyo Kabushiki Kaisha, Nagoya (JP)

(72) Inventor: Kakeru Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/268,850

(22) Filed: Feb. 6, 2019

(65) Prior Publication Data

US 2019/0284003 A1 Sep. 19, 2019

(30) Foreign Application Priority Data

Mar. 14, 2018 (JP) ..... 2018-046795
Oct. 9, 2018 (JP) ..... 2018-190666

(51) Int. Cl.
*B65H 29/70* (2006.01)
*B65H 29/52* (2006.01)
*B65H 29/14* (2006.01)

(52) U.S. Cl.
CPC ..... *B65H 29/70* (2013.01); *B65H 29/14* (2013.01); *B65H 29/52* (2013.01); *B65H 2301/51256* (2013.01); *B65H 2301/512565* (2013.01)

(58) Field of Classification Search
CPC ..... B65H 2301/512565; B65H 2301/51256; B65H 29/70; B65H 29/52; B65H 29/22;
(Continued)

(56) References Cited

U.S. PATENT DOCUMENTS 7,865,128 B2 * 1/2011 Lee ..... G03G 15/6552 271/188
7,957,674 B2 * 6/2011 Yamaguchi ..... G03G 21/1638 399/124
(Continued)

FOREIGN PATENT DOCUMENTS

JP 07101612 A * 4/1995
JP 2000-056530 A 2/2000
(Continued)

*Primary Examiner* — Luis A Gonzalez
(74) *Attorney, Agent, or Firm* — Burr & Brown, PLLC

(57) ABSTRACT

A sheet discharging device includes a housing, a drive roller, a first pinch roller, a second pinch roller, a holder, a guide member, and an urging member urging the first pinch roller toward the drive roller. The second pinch roller is positioned downstream of the first pinch roller in a discharging direction. The holder has a connecting portion supporting the first and second pinch rollers. The first pinch roller is movable between a contact position in contact with the drive roller and a separated position separated from the drive roller. Between the first and second pinch rollers in the discharging direction, the guide member is farther away from the drive roller than the connecting portion is when the first pinch roller is at the contact position, and is closer to the drive roller than the connecting portion is when the first pinch roller is at the separated position.

12 Claims, 14 Drawing Sheets

(58) Field of Classification Search
CPC .. B65H 29/125; B65H 29/14; G03G 15/6576; G03G 2215/00662
See application file for complete search history.

(56) References Cited

U.S. PATENT DOCUMENTS

| | | | | |
|---|---|---|---|---|
| 9,227,814 | B2 * | 1/2016 | Zhang | B65H 5/36 |
| 2006/0165455 | A1 * | 7/2006 | Kajita | G03G 15/6576 399/406 |
| 2017/0008713 | A1 * | 1/2017 | Yamaguchi | G03G 15/6529 |
| 2017/0102661 | A1 * | 4/2017 | Kameda | B65H 5/062 |
| 2017/0185026 | A1 * | 6/2017 | Yamaguchi | G03G 15/6552 |

FOREIGN PATENT DOCUMENTS

| | | | |
|---|---|---|---|
| JP | 2011153008 | A * | 8/2011 |
| JP | 2017-071459 | A | 4/2017 |

* cited by examiner

SHEET DISCHARGING DEVICE INCLUDING PINCH ROLLER MOVABLE RELATIVE TO DRIVE ROLLER, AND GUIDE MEMBER FOR GUIDING SHEETS

CROSS REFERENCE TO RELATED APPLICATION

This application claims priorities from Japanese Patent Application Nos. 2018-046795 filed Mar. 14, 2018 and 2018-190666 filed Oct. 9, 2018. The entire contents of the priority applications are incorporated herein by reference.

TECHNICAL FIELD

The present disclosure relates to a sheet discharging device having a sheet-curl correcting function.

BACKGROUND

There is conventionally known a sheet discharging device including rollers positioned adjacent to a sheet discharge outlet. These rollers not only have a sheet-conveying function and a sheet-curl correcting function in order to correct sheet curling and discharge corrected sheets to a sheet discharge tray. Sheet curling may occur during an image-processing process such as an image formation, and during a sheet-conveying process along a sheet conveying path.

Japanese Patent Application Publication No. 2000-056530 discloses a structure for correcting sheet curling using an upper roller and two lower rollers held by a holder and aligned with each other in a sheet conveying direction. A leaf spring is provided below the holder to urge the holder, so that the two lower rollers are brought into contact with the upper roller and are rotated in accordance with rotation of the upper roller. With this structure, a sheet is pressed along an outer peripheral surface of the upper roller by the two lower rollers to correct curing of the sheet.

SUMMARY

According to the structure disclosed in the above Japanese Publication, a portion of the sheet positioned between the two lower rollers is caused to curve in the conveying direction of the sheet, because the portion of the sheet is shaped to conform to the outer peripheral surface of the upper roller. Therefore, immediately after a trailing end portion of the sheet moves past the upstream lower roller, the trailing end portion may leap toward the holder. In case of conveyance of a sheet having a strong linearity or tensility such as a thick sheet or a pasteboard, the trailing end portion thereof may collide against an upper portion of the holder or a component in the vicinity of the holder to produce a collision noise, or to disturb sheet conveyance.

In view of the foregoing, it is an object of the disclosure to provide a sheet discharging device including a sheet-curl correcting function and capable of reducing leaping of a trailing end portion of a sheet.

In order to attain the above and other objects, according to one aspect, the disclosure provides a sheet discharging device including a housing, a drive roller, a first pinch roller, a second pinch roller, a holder, an urging member and a guide member. The drive roller is disposed in the housing and configured to discharge a sheet in a discharging direction. The first pinch roller is disposed to face the drive roller and is configured to contact the drive roller for rotation. The second pinch roller is disposed downstream relative to the first pinch roller in the discharging direction. The second pinch roller is configured to face the drive roller and contact the drive roller for rotation. The holder includes a connecting portion supporting the first pinch roller and the second pinch roller. The holder supports the first pinch roller to allow the first pinch roller to move between a contact position where the first pinch roller is in contact with the drive roller and a separated position where the first pinch roller is separated from the drive roller. The urging member is configured to urge the first pinch roller toward the drive roller. The guide member is provided at a predetermined position between the first pinch roller and the second pinch roller in the discharging direction. When the first pinch roller is at the contact position, the guide member is positioned farther away from the drive roller than the connecting portion of the holder is. When the first pinch roller is at the separated position against an urging force of the urging member, the guide member is positioned closer to the drive roller than the connecting portion of the holder is.

According to another aspect, there may be provided an image-processing apparatus including the above sheet discharging device, and an image-processing unit configured to form an image on the sheet. The image-processing unit is disposed in the housing at a position upstream relative to the sheet discharging device in the discharging direction.

According to still another aspect, the disclosure provides a sheet discharging device including a housing, a drive roller, a first pinch roller, a second pinch roller, a holder, an urging member, and a guide member. The drive roller is disposed in the housing and is configured to discharge a sheet in a discharging direction. The first pinch roller is disposed to face the drive roller and is configured to contact the drive roller for rotation. The second pinch roller is disposed downstream relative to the first pinch roller in the discharging direction. The second pinch roller is configured to face the drive roller and contact the drive roller for rotation. The holder includes a connecting portion supporting the first pinch roller and the second pinch roller. The holder supports the first pinch roller to allow the first pinch roller to move between a contact position where the first pinch roller is in contact with the drive roller and a separated position where the first pinch roller is separated from the drive roller. The urging member is configured to urge the first pinch roller toward the drive roller. The guide member is provided at a predetermined position. The guide member is separated from the sheet discharged from the drive roller when the first pinch roller is at the contact position. The guide member is configured to contact the sheet discharged from the drive roller to guide the sheet when the first pinch roller is at the separated position. In a state where the first pinch roller is at the contact position and the second pinch roller is in contact with the drive roller, a part of the guide member is positioned within a space defined between a first part of an outer peripheral surface of the first pinch roller and a second part of an outer peripheral surface of the second pinch roller, the first part and the second part facing each other. When the first pinch roller is at the contact position, the guide member is positioned farther away from the drive roller than the connecting portion of the holder is. When the first pinch roller is at the separated position against an urging force of the urging member, the guide member is positioned closer to the drive roller than the connecting portion of the holder is.

According to still another aspect, the disclosure provides a sheet discharging device including a housing, a drive roller, a first pinch roller, a second pinch roller, a holder, an urging member, and a guide member. The drive roller is disposed in the housing and is configured to discharge a sheet in a discharging direction. The first pinch roller is disposed to face the drive roller and contactable with the drive roller for rotation. The second pinch roller is disposed downstream relative to the first pinch roller in the discharging direction. The second pinch roller is configured to face the drive roller and contact the drive roller for rotation. The holder supports the first pinch roller and the second pinch roller. The holder supports the first pinch roller to allow the first pinch roller to move between a contact position where the first pinch roller is in contact with the drive roller and a separated position where the first pinch roller is separated from the drive roller. The urging member is configured to urge the first pinch roller toward the drive roller. The guide member is provided at a predetermined position. The guide member is separated from the sheet discharged from the drive roller when the first pinch roller at the contact position. The guide member is configured to contact the sheet discharged from the drive roller to guide the sheet when the first pinch roller is at the separated position. In a state where the first pinch roller is at the contact position and the second pinch roller is in contact with the drive roller, the predetermined position is within a space defined by: a first part of an outer peripheral surface of the first pinch roller; a second part of an outer peripheral surface of the second pinch roller, the first part and the second part facing with each other; and an imaginary line connecting a rotation axis of the first pinch roller and a rotation axis of the second pinch roller.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

A sheet discharging unit 8 as an example of a sheet discharging device according to one embodiment of the disclosure will be described with reference to FIGS. 1 through 13B.

Figure 1:
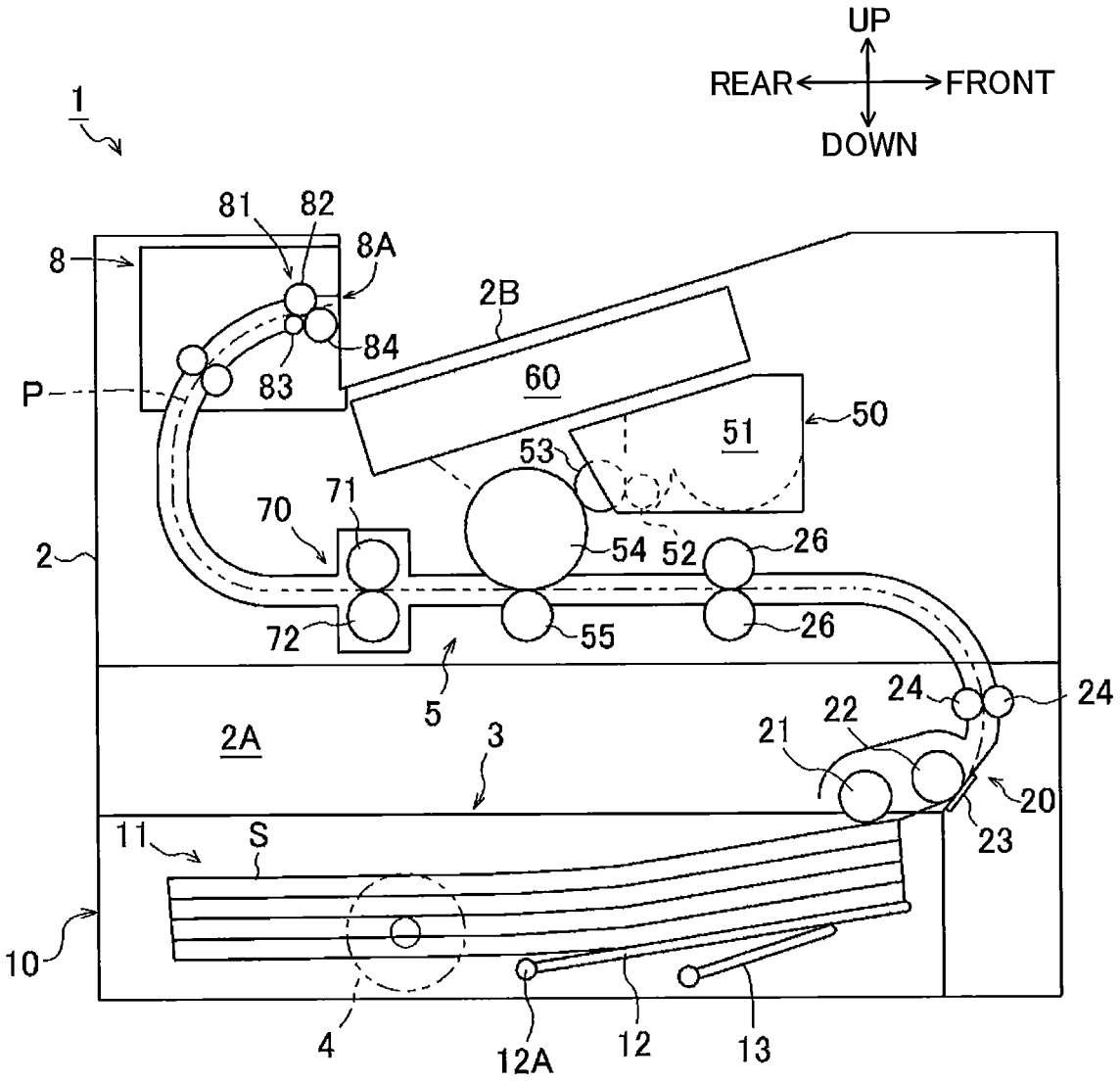
FIG. 1 is a central cross-sectional view of an image-forming apparatus incorporating a sheet discharging device according to one embodiment.

The sheet discharging unit 8 is assembled in an electrophotographic type image-forming apparatus 1 as illustrated in FIG. 1. Hereinafter, the expressions "front", "rear", "above", "below" and like are used to define various parts assuming that the image-forming apparatus 1 is disposed in an orientation in which it is intended to be used. Specific directions are indicated respectively in each of accompanying drawings.

<Overall Structure of Image-Forming Apparatus>

Referring to FIG. 1, the image-forming apparatus 1 of the embodiment includes a housing 2, a supply unit 3, a motor 4, an image-forming unit 5, and the sheet discharging unit 8.

The housing 2 includes a sheet-tray attachment portion 2A which is a lower portion of the housing 2, and a discharge tray 2B formed in an upper end portion of the housing 2. The housing 2 has a discharge opening 8A near the sheet discharging unit 8.

The supply unit 3 is positioned at a lower end portion of the housing 2. The supply unit 3 is configured to accommodate sheets B therein and convey the sheets S to the image-forming unit 5. The image-forming unit 5 is positioned downstream of the supply unit 3 in a sheet conveying direction, and is configured to form an image on each sheet S supplied from the supply unit 3. The sheet discharging unit 8 is positioned downstream of the image-forming unit 5 in the sheet conveying direction and is configured to discharge the sheet S on which the image is formed to an outside of the housing 2.

The supply unit 3 includes a sheet tray 10, a sheet supplying mechanism 20, a pair of conveyer rollers 24, and a pair of registration rollers 26. The supply unit 3 is attachable to and detachable from the sheet-tray attachment portion 2A.

The sheet tray 10 is attachable to and detachable from the sheet-tray attachment portion 2A. Specifically, the sheet tray 10 is inserted rearward into the sheet-tray attachment portion 2A to be attached thereto. The sheet tray 10 is thus placed at its attached position. When the sheet tray 10 at its attached position is withdrawn frontward to be detached from the sheet-tray attachment portion 2A, the sheet tray 10 is positioned at its pulled-out position.

The sheet tray 10 includes a tray body 11 for accommodating a stack of sheets S, a pressure plate 12 and a lifter plate 13. The pressure plate 12 is provided at the tray body 11 and is configured to support the stack of sheets S from below to allow the stack of sheets S to move vertically. The lifter plate 13 is configured to move the pressure plate 12 vertically.

Specifically, the pressure plate 12 has a base end portion connected to a pivot shaft 12A, so that the pressure plate 12 is pivotally movable in a vertical direction about an axis of the pivot shaft 12A. The lifter plate 13 has a base end portion driven by the motor 4, and a free end portion in contact with a free end portion of the pressure plate 12. When driven by the motor 4, the lifter plate 13 is pivoted upward so that the free end portion of the lifter plate 13 is lifted up to push the free end portion of the pressure plate 12 up to a position as illustrated in FIG. 1. At the position shown in FIG. 1, the stack of sheets S placed on the pressure plate 12 is lifted up to be conveyed to the sheet supplying mechanism 20.

The sheet supplying mechanism 20 is configured to separate the stacked sheets S one by one and convey each separated sheet S (uppermost sheet) to the pair of conveyer rollers 24. The sheet supplying mechanism 20 includes a pick-up roller 21, a separation roller 22 and a separation pad 23.

The pick-up roller 21 is positioned above the pressure plate 12. The pick-up roller 21 is configured to pick-up the sheets S lifted up by the pressure plate 12. The separation roller 22 is positioned downstream of the pick-up roller 21 in the sheet conveying direction. The separation pad 23 is positioned to oppose the separation roller 22, and is urged toward the separation roller 22.

The sheet S picked up by the pick-up roller 21 is conveyed to the separation roller 22, separated one by one between the separation roller 22 and the separation pad 23, and then conveyed to the pair of conveyer rollers 24.

The pair of conveyer rollers 24 is positioned downstream of the sheet supplying mechanism 20 in the sheet conveying direction. The conveyer rollers 24 is configured to impart conveying force to the sheet S. The sheet S conveyed to the conveyer rollers 24 from the sheet supplying mechanism 20 is then conveyed to the pair of registration rollers 26.

The pair of registration rollers 26 is positioned downstream of the pair of conveyer rollers 24. The registration rollers 26 is configured to regulate movement of a leading end of each sheet S for temporarily stopping conveyance of the sheet S, and then convey the sheet S to a transfer position defined in the image-forming unit 5 at a prescribed timing.

The image-forming unit 5 includes a process cartridge 50, an exposure unit 60, and a fixing unit 70. The process cartridge 50 includes a photosensitive drum 54 and is configured to form an image on a surface of the sheet S conveyed from the supply unit 3. The exposure unit 60 is configured to expose a peripheral surface of the photosensitive drum 54 to light. The fixing unit 70 is configured to thermally fix the image transferred from the process cartridge 50 to the sheet S.

The process cartridge 50 is positioned above the sheet-tray attachment portion 2A within the housing 2. The process cartridge 50 includes a developer accommodation chamber 51, a supply roller 52, a developing roller 53, the photosensitive drum 54, and a transfer roller 55.

The developer accommodation chamber 51 accommodates therein toner as developer. The toner accommodated in the developer accommodation chamber 51 is supplied to the supply roller 52 while being agitated by an agitator (not illustrated). The supply roller 52 is configured to supply the toner to the developing roller 53.

The developing roller 53 is in contact with the supply roller 52 and is configured to carry the toner supplied from the supply roller 52. The developing roller 53 is configured to be applied with developing bias by means of a bias application unit (not illustrated).

The photosensitive drum 54 is positioned adjacent to the developing roller 53. The peripheral surface of the photosensitive drum 54 is uniformly charged by a charger (not illustrated), and is then exposed to light by the exposure unit 60. On the peripheral surface of the photosensitive drum 54, electric potential becomes lower at an exposed region than at a non-exposed region, thereby producing an electrostatic latent image on a basis of image data. As the charged toner is supplied from the developing roller 53, the electrostatic latent image becomes visible developer image on the peripheral surface of the photosensitive drum 54.

The transfer roller 55 is positioned to oppose the photosensitive drum 54, and is applied with a negative transfer bias by the bias application unit (not illustrated). When the sheet S conveyed from the registration rollers 26 is nipped between the photosensitive drum 54 and the transfer roller 55 while the transfer bias is applied to the surface of the transfer roller 55, the developer image formed on the peripheral surface of the photosensitive drum 54 is transferred onto the surface of the sheet S. A position at which the photosensitive drum 54 and the transfer roller 55 nip the sheet S therebetween is the transfer position.

The exposure unit 60 includes a laser diode, a polygon mirror, a lens, and a reflection mirror those not illustrated. The exposure unit 60 is configured to scanningly emit laser light to the photosensitive drum 54 based on inputted image data so as to expose the peripheral surface of the photosensitive drum 54 to light.

The fixing unit 70 includes a heat roller 71 and a pressure roller 72. The heat roller 71 is configured to be rotationally driven by a driving force from the motor 4, and heated upon power supply from a power source (not illustrated). The pressure roller 72 is positioned in confrontation with and in contact with the heat roller 71. The pressure roller 72 is thus configured to rotate by the rotation of the heat roller 71. The sheet S with the developer image transferred thereto is conveyed to and nipped between the heat roller 71 and the pressure roller 72, whereupon the developer image is thermally fixed to the sheet S. In the fixing unit 70, the sheet S heated by the heat roller 71 may be curled to be convex downward. That is, the sheet S passing through the fixing unit 70 may be curled such that an upper surface (the surface heated by the heat roller 71) of the sheet S provides an inner curvature and a lower surface of the sheet S provides an outer curvature.

The sheet discharging unit 8 includes a discharge mechanism 81. The sheet discharging unit 8 is configured to discharge the sheet S conveyed from the fixing unit 70, through the discharge opening 8A, to the outside of the housing 2, that is, onto the discharge tray 2B. The sheet discharging unit 8 will be described next in detail.

<Sheet Discharging Unit>

The discharge mechanism 81 is configured to discharge the sheet S conveyed from the fixing unit 70 to the discharge tray 2B through the discharge opening 8A. Incidentally, a conveyer passage P extending from the fixing unit 70 to the discharge mechanism 81 is indicated by a two-dotted chain line in FIG. 1. The conveyer passage P is curved to extend rearward from the fixing unit 70, and then upward and then frontward to the discharge mechanism 81. Due to the curved shape of the conveyer passage P downstream of the fixing unit 70 in a discharging direction, the sheet S may be curled such that the surface of the sheet S facing frontward provides a concave while being conveyed along the conveyer passage P.

Figure 2:
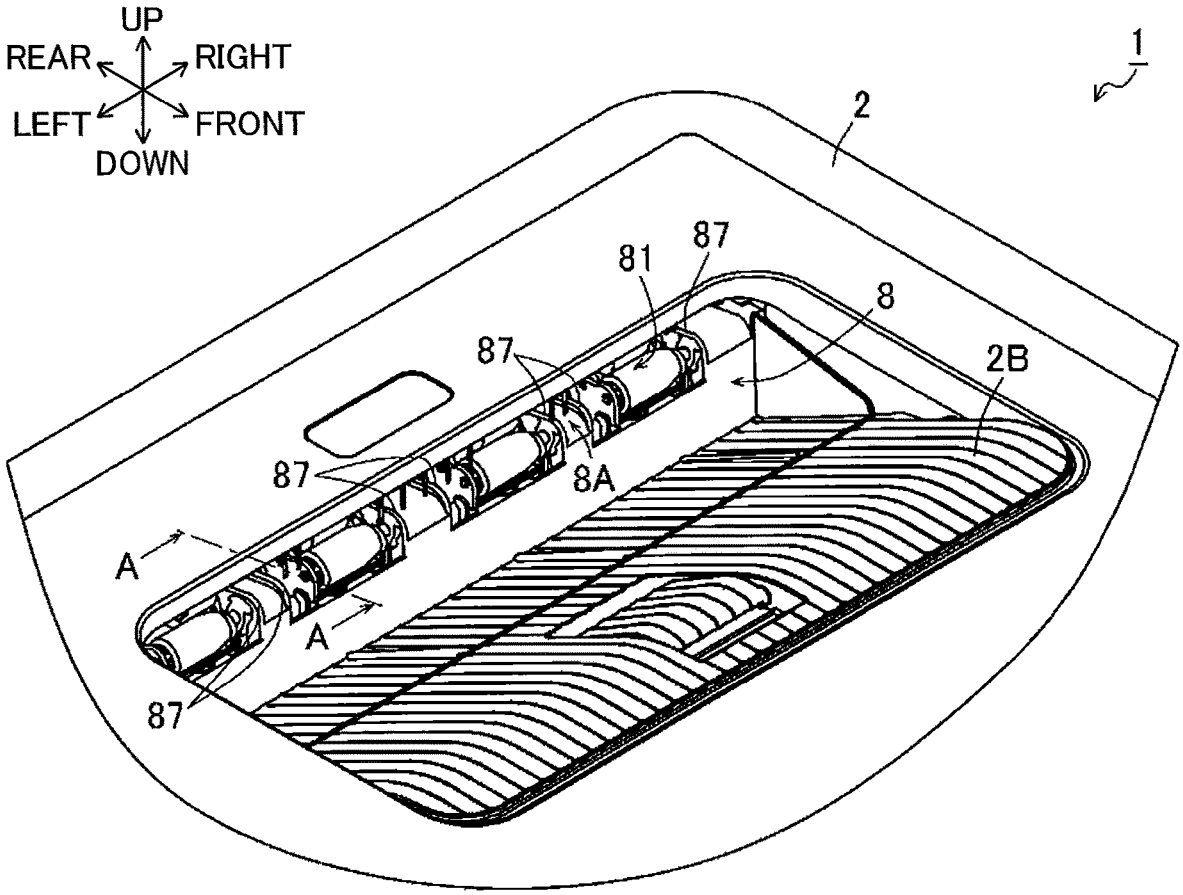
FIG. 2 is a perspective view illustrating a structure near a discharge mechanism of the sheet discharging unit according to the embodiment.

The discharge mechanism 81 includes four sets of: a drive roller 82, a first pinch roller 83, a second pinch roller 84, a holder 85, an urging member 86, and a pair of guide members 87. The four sets are arranged to be aligned with one another in a left-right direction, as illustrated in FIG. 2. Hereinafter, only one of the four sets will be described in detail for simplifying explanation.

Figure 3:
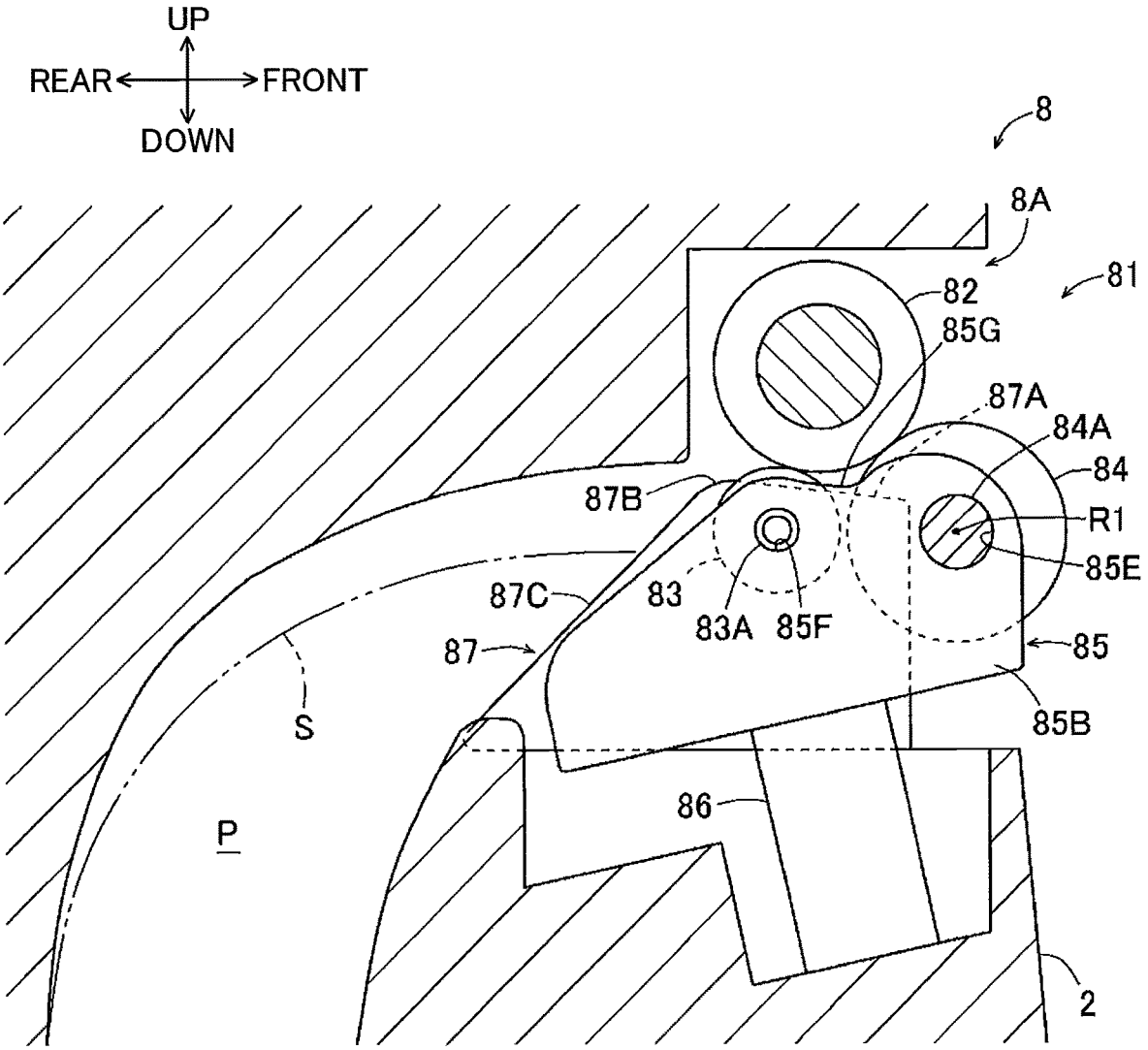
FIG. 3 is a cross-sectional view of the discharge mechanism taken along a line A-A in FIG. 2.

As illustrated in FIG. 3, the drive roller 82 is positioned adjacent to the discharge opening 8A of the housing 2, and above the conveyer passage P. The drive roller 82 is configured to receive driving force from the motor 4. The drive roller 82 is configured to make contact with the first pinch roller 83 to provide a nip therewith, while the drive roller 82 is in contact with the second pinch roller 84 to provide a nip therewith. With this configuration, the drive roller 82 serves to convey the sheet P conveyed along the conveyer passage P in the discharging direction. In the present embodiment, the first pinch roller 83 has a diameter smaller than a diameter of the drive roller 82 and a diameter of the second pinch roller 84.

The first pinch roller 83 is positioned adjacent to the discharge opening 8A of the housing 2, and below the drive roller 82. The first pinch roller 83 is positioned to oppose the drive roller 82. The first pinch roller 83 includes a roller shaft 83A that is rotatably supported by the holder 85. When the first pinch roller 83 is in contact with the drive roller 82 to provide a nip therebetween (i.e., in a state depicted in FIG. 3), the first pinch roller 83 is caused to rotate by the rotation of the drive roller 82.

The second pinch roller 84 is positioned adjacent to the discharge opening 8A of the housing 2, and below the drive roller 82 such that the second pinch roller 84 is positioned so as to be capable of facing the drive roller 82. The second pinch roller 84 is positioned downstream of the first pinch roller 83 in the discharging direction. The second pinch roller 84 includes a roller shaft 84A defining a first axis R1. The roller shaft 84A is rotatably supported by the housing 2 so that the second pinch roller 84 is rotatable about the first axis R1. The second pinch roller 84 is rotatable by the rotation of the drive roller 82, since the second pinch roller 84 is in contact with the drive roller 82 to form a nip position therewith.

As described above, since the drive roller 82 forms the nip with each of the first pinch roller 83 and the second pinch roller 84, the sheet S is conveyed along an outer peripheral surface of the drive roller 82 with a pressure from the first pinch roller 83 and the second pinch roller 84. Thus, curling of the sheet S can be corrected.

Figure 4A:
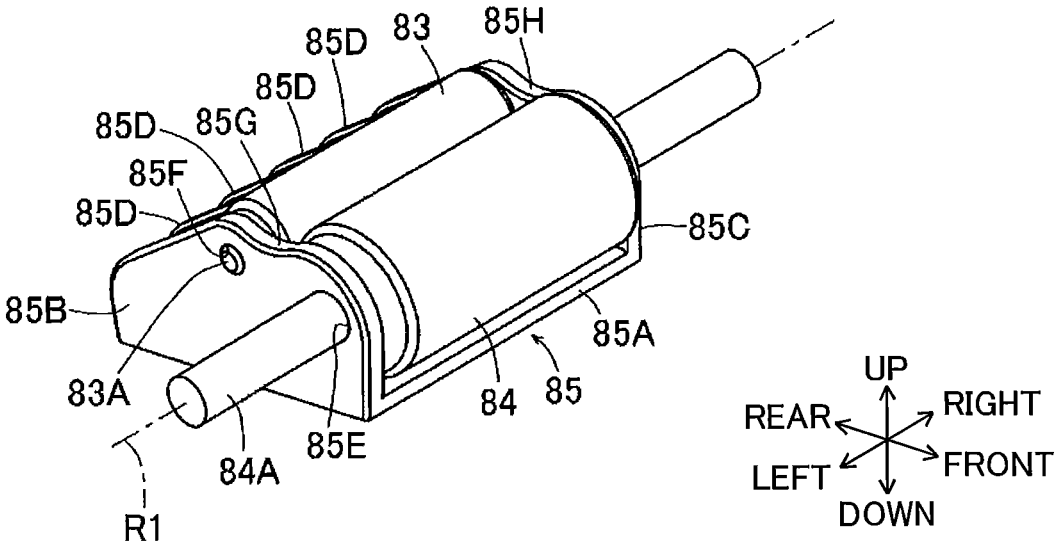
FIG. 4A is a perspective view illustrating a lower portion of the discharge mechanism as viewed from a front side thereof according to the embodiment.
Figure 4B:
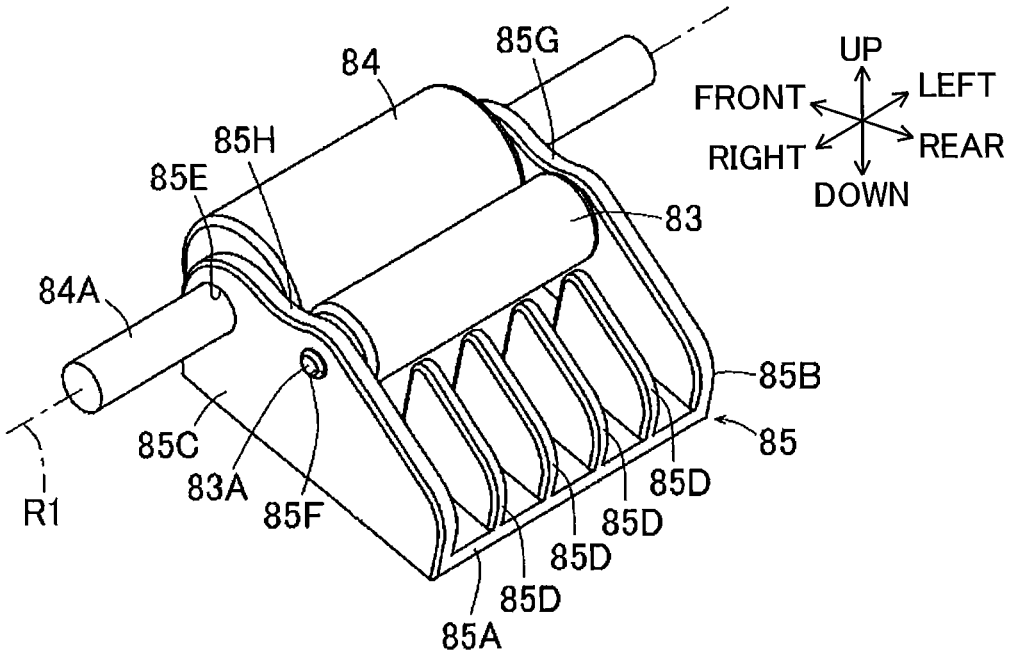
FIG. 4B is a perspective view illustrating the lower portion of the discharge mechanism as viewed from a rear side thereof according to the embodiment.

As illustrated in FIGS. 4A and 4B, the holder 85 includes a holder base 85A, a left holder portion 85B, a right holder portion 85C and four guide ribs 85D. The holder base 85A has a generally rectangular plate shape. The left holder portion 85B is generally plate shaped and extends upward from a left end portion of the holder base 85A. The left holder portion 85B is perpendicular to the holder base 85A. The right holder portion 85C is also generally plate shaped and extends upward from a right end portion of the holder base 85A. The right holder portion 85C is perpendicular to the holder base 85A. The four guide ribs 85D protrude upward from the holder base 85A to be perpendicular to the holder base 85A. The four guide ribs 85D are aligned with one another in the left-right direction.

Each of the left holder portion 85B and the right holder portion 85C is formed with a hole 85E through which the roller shaft 84A of the second pinch roller 84 extends. Because the roller shaft 84A is supported to the housing 2 and the roller shaft 84A extends through each of the holes 85E, the holder 85 is pivotally movable about the first axis R1 relative to the housing 2. Further, each of the left holder portion 85B and the right holder portion 85C is formed with a hole 85F through which the roller shaft 83A of the first pinch roller 83 extends. Thus, the holder 85 rotatably supports the first pinch roller 83.

The left holder portion 85B and the right holder portion 85C are symmetrical with each other in the left-right direction. The left holder portion 85B has an upper end portion 85H facing the drive roller 82, and the right holder portion 85C has an upper end portion 85G facing the drive roller 82. These upper end portions 85H and 85G function to guide the leading end portion of the sheet S. The upper end portion 85H is positioned between the first pinch roller 83 and the second pinch roller 84 as viewed in an axial direction of the roller shaft 84A, and is recessed downward. Similarly, the upper end portion 85G is positioned between the first pinch roller 83 and the second pinch roller 84 as viewed in the axial direction of the roller shaft 84A, and is recessed downward.

The guide ribs 85D are positioned upstream of the first pinch roller 83 in the discharging direction. Each guide rib 85D has a height that is equal to a height of each upstream portion of the left holder portion 85B and the right holder portion 85C. The guide ribs 85D are configured to guide the leading end portion of the sheet S to a nip position defined between the first pinch roller 83 and the drive roller 82 in cooperation with the upstream portions of the left holder portion 85B and the right holder portion 85C.

Thus, the holder 85 supports both the first pinch roller 83 and the second pinch roller 84 and is pivotally movable about the first axis R1. In accordance with the pivotal movement of the holder 85, the first pinch roller 83 is movable between a contact position (FIG. 3) where the first pinch roller 83 is in contact with the drive roller 82 and a separated position (FIG. 5) where the first pinch roller 83 is separated from the drive roller 82.

As illustrated in FIG. 3, the urging member 86 is configured to urge the first pinch roller 83 toward the drive roller 82, that is in a direction from the separated position toward the contact position. Resiliently deformable member such as a spring and a rubber is available as the urging member 86. In the present embodiment, a compression coil spring is employed as the urging member 86. Specifically, the urging member 86 is interposed between the holder base 85A of the holder 85 and the housing 2 so as to urge the holder base 85A upward. Hence, the first pinch roller 83 is positioned at the contact position as long as no sheet S is conveyed; but the first pinch roller 83 is moved downward to the separated position against urging force of the urging member 86 when applied with certain linearity of the sheet S.

As illustrated in FIG. 2, the pair of guide members 87 is positioned one beside each axial end portion of the first pinch roller 83. The guide members 87 are configured to guide the sheet S in a state where the first pinch roller 83 is moved to the separated position against the urging force of the urging member 86. In the present embodiment, each guide member 87 is a rib formed at the housing 2 so as to constitute a lower edge of the conveyer passage P near the discharge opening 8A.

As illustrated in FIG. 3, each guide member 87 includes a guide portion 87A, a guide portion 87B, and a guide portion 87C.

The guide portion 87A is positioned between the first pinch roller 83 and the second pinch roller 84 in the discharging direction (i.e., the conveying direction). The guide portion 87A is inclined to extend away from the drive roller 82 in a direction from the first pinch roller 83 toward the second pinch roller 84. As viewed in the left-right direction in FIG. 3, the guide portion 87A has a part overlapped with a circular region provided by the first pinch roller 83, another part overlapped with a circular region provided by the second pinch roller 84, and still another part overlapped with a region between the two circular regions. The guide portion 87A is inclined diagonally downward and frontward. Specifically, the guide portion 87A is partly overlapped with a spatial region spanning from the circular region of the first pinch roller 83 to the circular region of the second pinch roller 84 as viewed in the axial direction (left-right direction) of the first pinch roller 83 and the second pinch roller 84.

The guide portion 87B is positioned upstream of the guide portion 87A in the discharging direction. The guide portion 87B is curved into an arcuate convex shape protruding toward a space of the conveyer passage P. The guide portion 87B is positioned upstream of the first pinch roller 83 in the discharging direction.

The guide portion 87C is positioned upstream of the guide portion 87B in the discharging direction. The guide portion 87C is sloped to approach the drive roller 82 in the discharging direction. In other words, the guide portion 87C is sloped upward in a direction from a rear end of the guide member 87 toward the guide portion 87B so as to gradually narrow the space of the conveying passage P in the discharging direction.

Next, a positional relationship between the guide members 87 and the first pinch roller 83 in terms of an up-down direction will be described.

As illustrated in FIG. 3, the first pinch roller 83 protrudes farther upward relative to the guide members 87 when the first pinch roller 83 is at the contact position. Specifically, when the first pinch roller 83 is at the contact position, an upper end portion of the first pinch roller 83 is positioned above an upper end of the guide portion 87A of each guide member 87.

Figure 5:
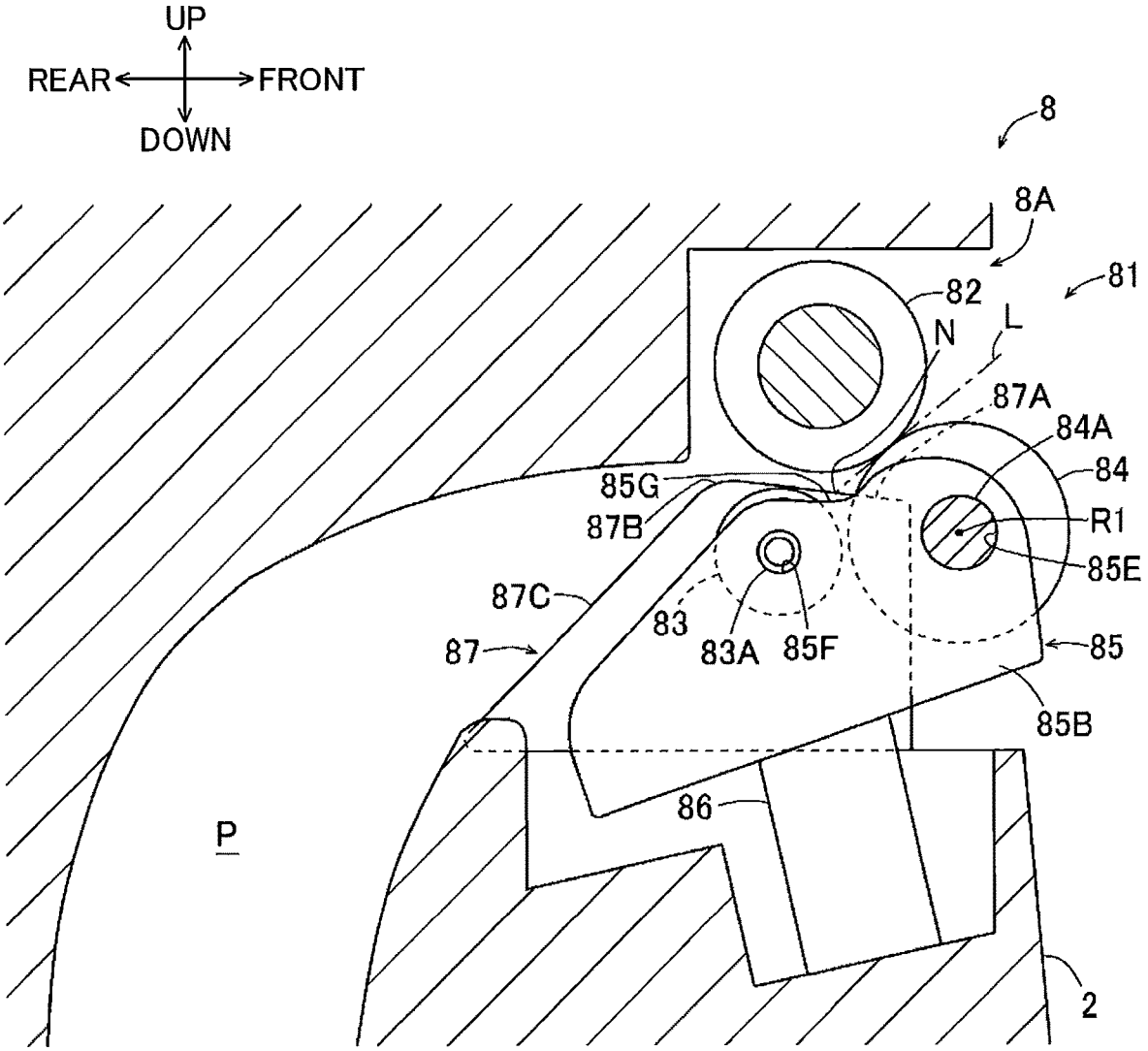
FIG. 5 is a cross-sectional view of the discharge mechanism according to the embodiment taken along the line A-A in FIG. 2, and illustrating a state where a first pinch roller is displaced to a separated position thereof.

On the other hand, as illustrated in FIG. 5, the upper end of the first pinch roller 83 is at a height equal to that of the guide members 87 when the first pinch roller 83 is at the separated position. Specifically, the upper end of the first pinch roller 83 is positioned at the same height as the upper end of the guide portion 87A of each guide member 87 when the first pinch roller 83 is at the separated position. Hence, the sheet S is conveyed along the upper end of the first pinch roller 83 and the upper end of the guide portion 87A of each guide member 87.

Next, a positional relationship between the guide members 87 and the holder 85 in terms of up-down direction will be described.

As illustrated in FIG. 3, the upper end portions 85G, 85H of the holder 85 are positioned above the guide members 87 when the first pinch roller 83 is at the contact position. Specifically, when the first pinch roller 83 is at the contact position, the upper end portions 85G, 85H of the holder 85 are positioned above the upper end of the guide portion 87A of each guide member 87.

On the other hand, as illustrated in FIG. 5, the upper end portions 85G, 85H of the holder 85 are positioned below the guide members 87 when the first pinch roller 83 is at the separated position. Specifically, the upper end portions 85G, 85H of the holder 85 are positioned below the upper end of the guide portion 87A of each guide member 87 when the first pinch roller 83 is at the separated position.

Further, when the first pinch roller 83 is at the separated position, the upper end portions 85G, 85H of the holder 85 is positioned opposite to the drive roller 82 with respect to an intersection point N defined by the guide portion 87A and a nip line L between the drive roller 82 and the second pinch roller 84, the nip line L being a common tangential line of the drive roller 82 and the second pinch roller 84. That is, the upper end portions 85G, 85H of the holder 85 are positioned below the intersection point N when the first pinch roller 83 is at the separated position. With this structure, the sheet S can be guided by the guide portions 87A without being in contact with the upper end portions 85G, 85H of each holder 85.

Next, sheet discharging operations performed by the discharge mechanism 81 will be described with reference to FIGS. 6 through 9.

Figure 6:
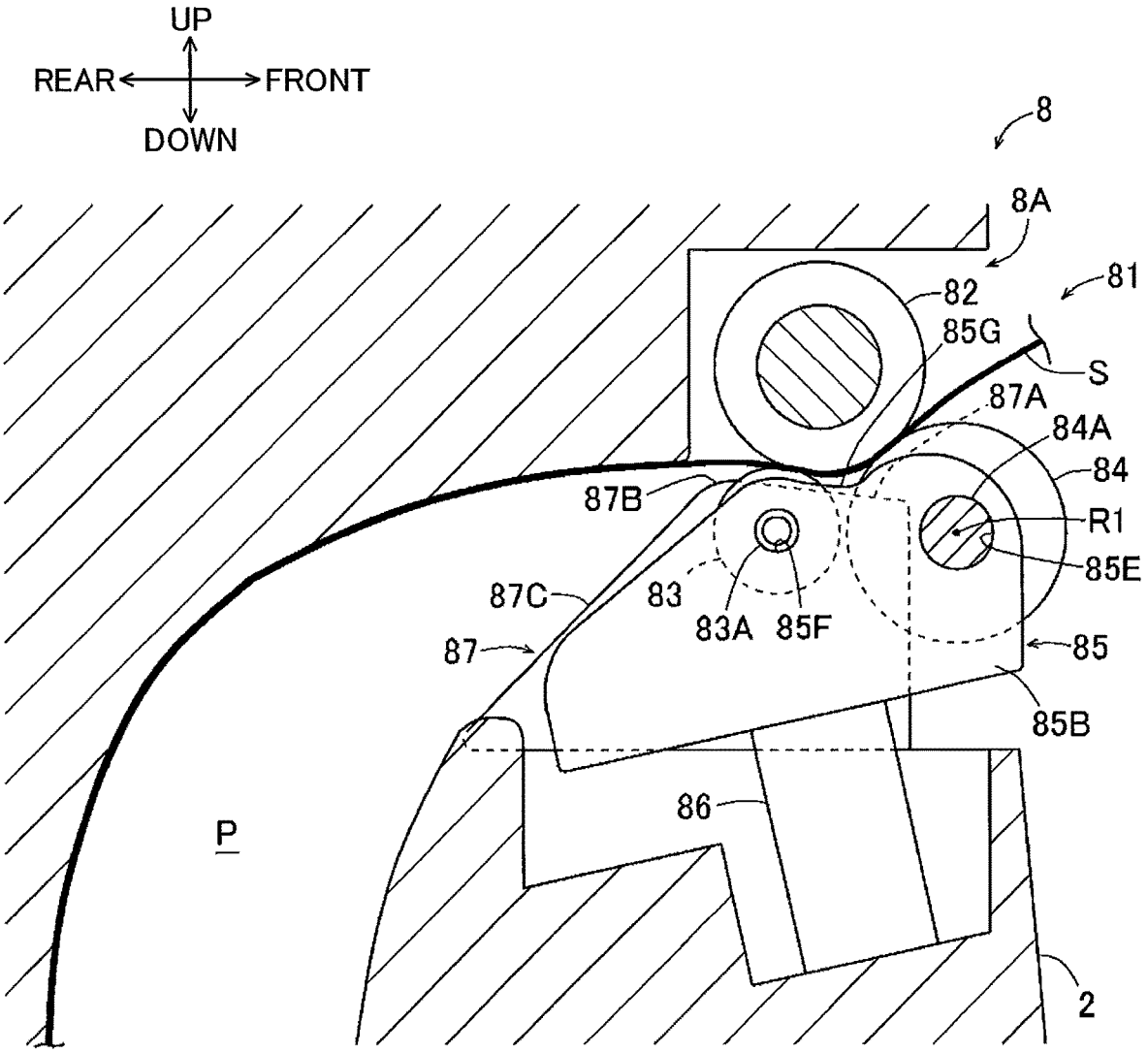
FIG. 6 is a cross-sectional view of the discharge mechanism according to the embodiment and illustrating a state where a sheet having low linearity is being conveyed through a drive roller, the first pinch roller and a second pinch roller.
Figure 7:
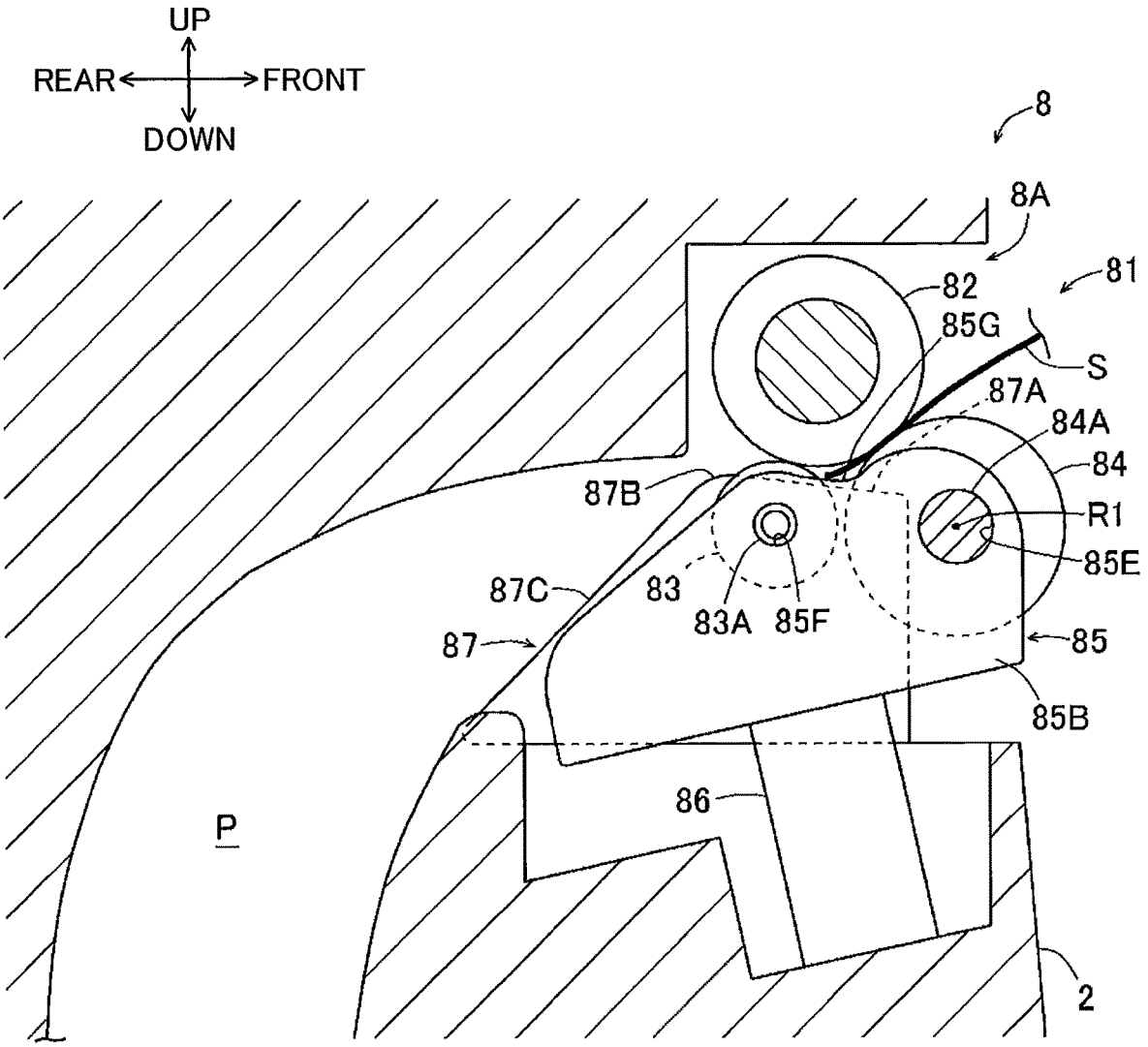
FIG. 7 is a cross-sectional view of the discharge mechanism according to the embodiment and illustrating a state immediately after a trailing end portion of the sheet having low linearity has just passed a nip position between the drive roller and the first pinch roller after the state of FIG. 6.
Figure 8:
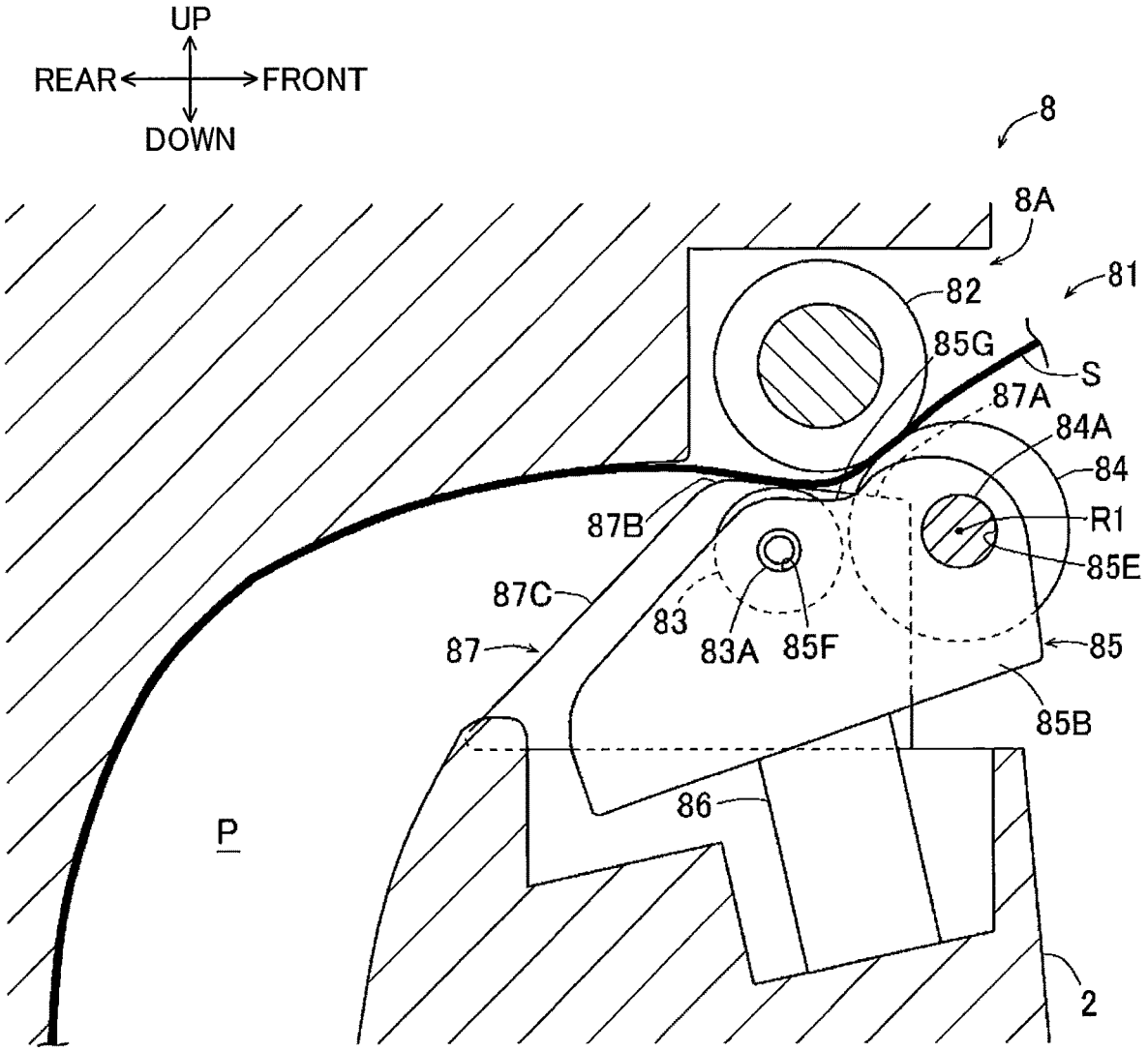
FIG. 8 is a cross-sectional view of the discharge mechanism according to the embodiment and illustrating a state where a sheet having high linearity is being conveyed through the drive roller, the first pinch roller and the second pinch roller.
Figure 9:
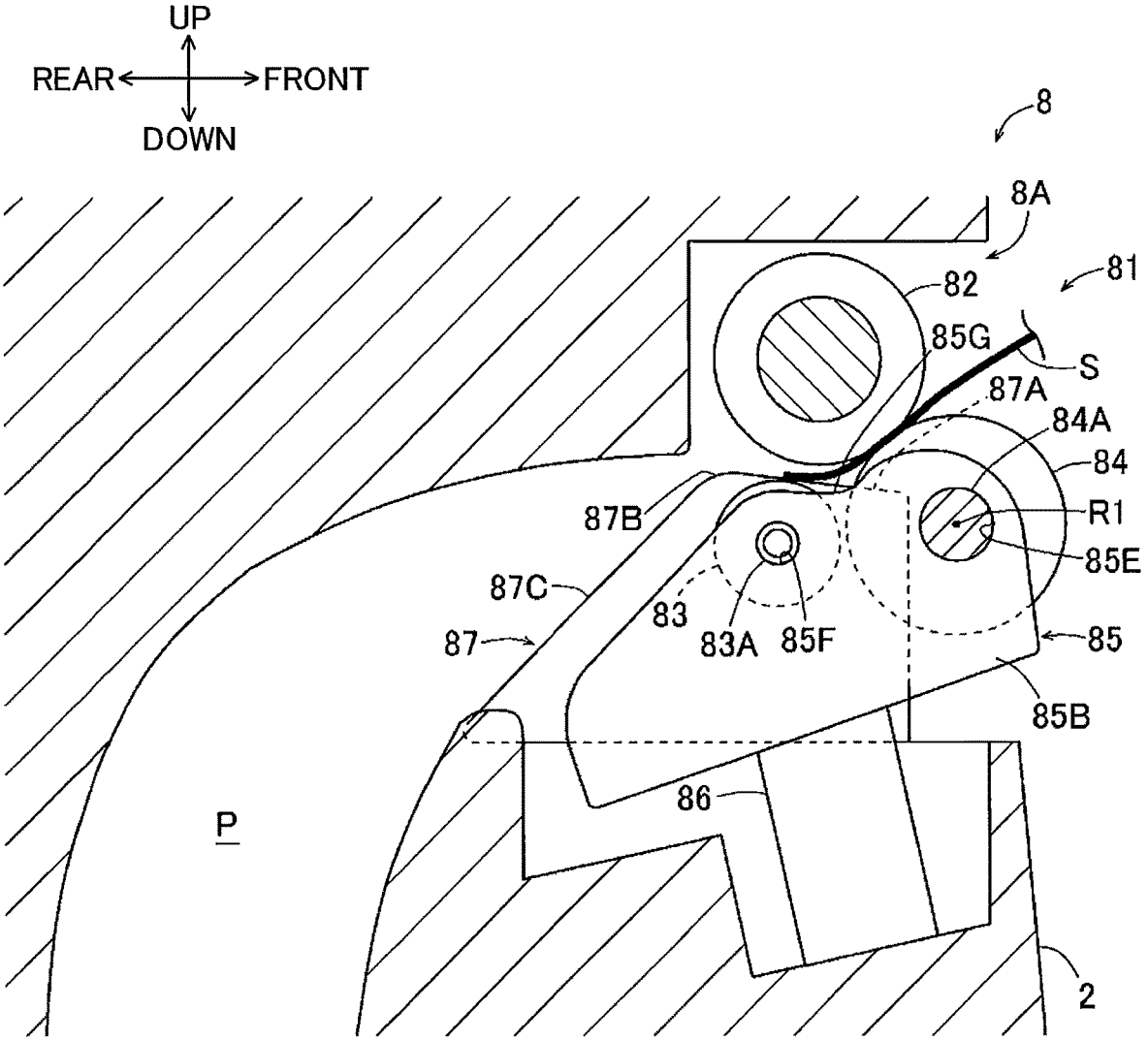
FIG. 9 is a cross-sectional view of the discharge mechanism according to the embodiment and illustrating a state where a trailing end portion of the sheet having high linearity is placed on the first pinch roller after the state of FIG. 8.

FIGS. 6 and 7 illustrate states where a sheet S having low linearity is being conveyed, and FIGS. 8 and 9 illustrate states where a sheet S having high (strong) linearity is being conveyed. Specifically, FIG. 6 is a cross-sectional view of the discharge mechanism 81 illustrating a state where a sheet S having low linearity is passing through the drive roller 82, the first pinch roller 83 and the second pinch roller 84. FIG. 7 is a cross-sectional view of the discharge mechanism 81 illustrating a state just after a trailing end portion of the sheet S having low linearity moves past the nip position between the drive roller 82 and the first pinch roller 83.

Incidentally, as described above, the sheet S conveyed to a position immediately upstream of the discharge mechanism 81 is curled to be convex upward in the sheet conveying direction, since the sheet S has passed through the image-forming unit 5 and conveyed along the curved conveyer passage P. Therefore, in the present embodiment, the discharge mechanism 81 is configured to deform the sheet S to become convex downward to correct the curling of the sheet S.

Referring to FIGS. 6 and 7, in case of conveyance of a sheet S having low linearity such as a thin sheet, the sheet S is conveyed along the conveyor passage P to the nip position between the drive roller 82 and the first pinch roller 83, and then conveyed along the outer peripheral surface of the drive roller 82 to a nip position between the drive roller 82 and the second pinch roller 84. The sheet S is then discharged through the discharge opening 8A. The leading end portion of the sheet S is guided by the upper end portions 85G, 85H while moving from the first pinch roller 83 to the second pinch roller 84.

As illustrated in FIG. 6, in a case where the sheet S having low linearity is conveyed, the first pinch roller 83 is maintained at its contact position, since a force of the sheet S for pressing the first pinch roller 83 downward is lower than an urging force of the urging member 86. Therefore, the sheet S is conveyed along the outer peripheral surface of the drive roller 82 while being conveyed from the nip position between the drive roller 82 and the first pinch roller 83 to the nip position between the drive roller 82 and the second pinch roller 84. The sheet S is thus curved to be convex downward during the conveyance along the outer peripheral surface of the drive roller 82, thereby firmly correcting the upwardly-convex curling of the sheet S.

Subsequently, as illustrated in FIG. 7, the trailing end portion of the sheet S moves past the nip position between the drive roller 82 and the first pinch roller 83. At this moment, the trailing end portion of the sheet S is separated from the drive roller 82 and moves downward to collide with the upper end portions 85G, 85H of the holder 85. Here, noisy collision sound is not generated because of low linearity of the sheet S. In case of conveyance of the sheet S having low linearity, large curl is likely to be generated at the time of image formation and sheet conveyance. Therefore, the large curling of the sheet S should be efficiently corrected by the discharge mechanism 81. According to the present embodiment, such large curling can be readily corrected for the sheets S with low linearity, since the first pinch roller 83 is maintained at its contact position.

Next discharging operations with respect to the sheet S having high linearity will be described with reference to FIGS. 8 and 9. FIG. 8 is a cross-sectional view of the discharge mechanism 81 illustrating a state where the sheet S having strong linearity is just passing through the drive roller 82, the first pinch roller 83 and the second pinch roller 84. FIG. 9 is a cross-sectional view of the discharge mechanism 81 illustrating a state where a trailing end portion of the sheet S having strong linearity is on the first pinch roller 83.

In case of conveyance of the sheet S having high linearity such as a thick sheet, the sheet S is first conveyed along the conveyor passage P to the nip position between the drive roller 82 and the first pinch roller 83. Then, while the sheet S is conveyed to the nip position between the drive roller 82 and the second pinch roller 84 and discharged through the discharge opening 8A, the sheet S pushes the first pinch roller 83 downward to the separated position. The leading end portion of the sheet S is conveyed from the first pinch roller 83 to the second pinch roller 84 while being guided by the upper end portions 85G, 85H of the holder 85.

When conveying the sheet S having high linearity, the first pinch roller 83 is moved to the separated position since the force of sheet S for pressing the first pinch roller 83 downward is greater than the urging force of the urging member 86. Hence, the trailing end portion of the sheet S is conveyed along the guide portions 87A from a position where the trailing end portion is in contact with the first pinch roller 83 and the guide portions 87A to the nip position between the drive roller 82 and the second pinch roller 84. Accordingly, the trailing end portion of the sheet S is conveyed without hopping movement, thereby reducing impacting noise. Regarding the sheet S having high linearity, only small sheet curling tends to occur at the time of image formation and sheet conveyance. Hence, strong correction to curling is not required in the discharge mechanism 81. In this way, with regard to the sheet S having high linearity, movement of the first pinch roller 83 to the separated position can reduce impacting noise without rigorous correction to the curling to the sheet S.

Next, fundamental functions according to the embodiment will be described with reference to simplified schematic illustrations of FIGS. 10A to 13B.

Figure 10A:
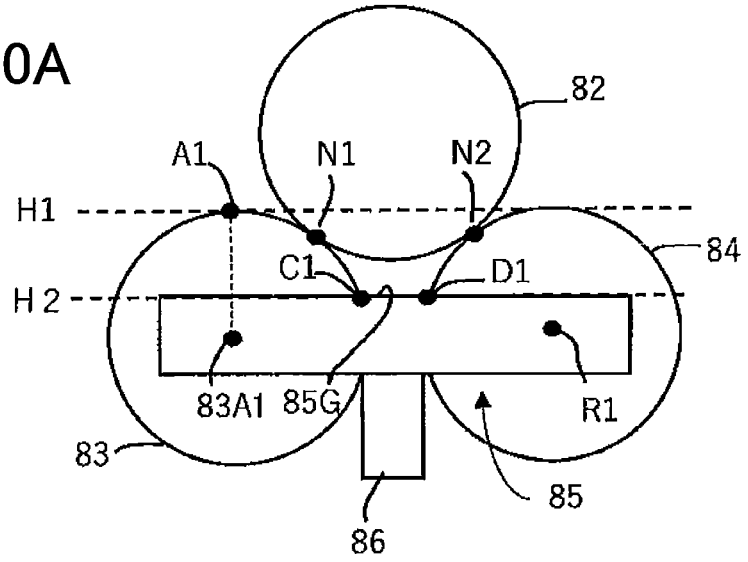
FIG. 10A is a simplified schematic diagram explaining how a sheet with low linearity is conveyed in a structure where no guide portion is provided as a comparative example, and illustrating a state prior to conveyance of the sheet.
Figure 10B:
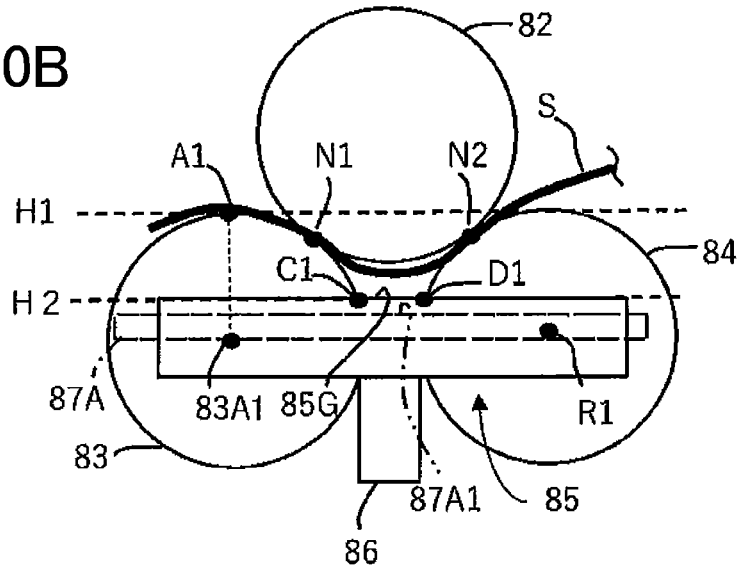
FIG. 10B is a simplified schematic diagram explaining how a sheet with low linearity is conveyed in a structure where a guide portion is provided in a horizontal orientation, and illustrating a state where the sheet having low linearity is being conveyed through the drive roller, the first pinch roller and the second pinch roller.
Figure 10C:
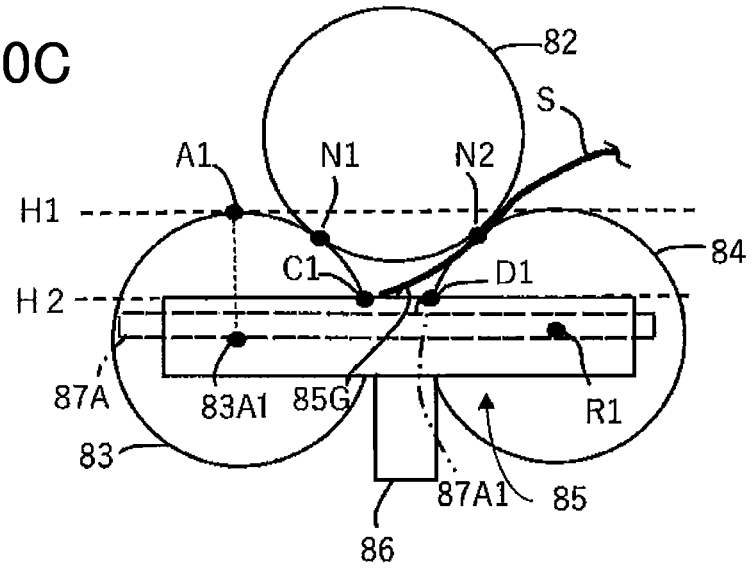
FIG. 10C is a simplified schematic diagram explaining how a sheet with low linearity is conveyed in the structure of FIG. 10B, and illustrating a state immediately after a trailing end portion of the sheet moves past a nip position between the drive roller and first pinch roller.

FIGS. 10A through 10C are views for describing conveyance of the sheet S having low linearity, and FIGS. 11A through 13B are views for describing conveyance of the sheet S having high linearity. In FIGS. 10B, 10C, 11B through 12A, the guide portion 87A is disposed in a horizontal orientation, whereas in FIGS. 13A and 13B, the guide portion 87A is disposed in an inclined orientation. Further, FIGS. 11A through 13B illustrate states where the first pinch roller 83 is separated from the drive roller 82 due to high linearity of the sheet S. Incidentally, for the sake of facilitating understanding, linearity of the thick sheet S is assumed to be identical to one another in FIGS. 11A through 13B, so that the first pinch roller 83 is assumed to be displaced downward by a constant amount from the drive roller 82 in these drawings.

As a comparative example, FIG. 10A depicts a configuration in which no guide portion 87A is provided. In FIG. 10A, no sheet S is conveyed, and the first pinch roller 83 and the second pinch roller 84 are both in contact with the drive roller 82. Here, N1 stands for the nip position between the first pinch roller 83 and the drive roller 82, and N2 stands for the nip position between the second pinch roller 84 and the drive roller 82. Further, as viewed in the axial direction of the first pinch roller 83 and the second pinch roller 84, a point C1 stands for an intersection point between the upper end portion 85G of the holder 85 and an outer peripheral surface of the first pinch roller 83; a point D1 stands for an intersection point between the upper end portion 85G of the holder 85 and an outer peripheral surface of the second pinch roller 84; and a broken line H2 stands for a line connecting the point C1 to the point D1. Further, A1 stands for an uppermost end of the outer peripheral surface of the first pinch roller 83, and a broken line H1 stands for a line perpendicular to a vertical line segment connecting the uppermost end A1 and an axis 83A1 of the roller shaft 83A.

FIG. 10B depicts a structure in which the guide portion 87A is incorporated in the structure of FIG. 10A and illustrates a state where the sheet S having low linearity is being conveyed. The guide portion 87A has an upper end surface 87A1 that is positioned between the first pinch roller 83 and the second pinch roller 84 in the discharging direction. This upper end surface 87A1 is positioned farther away from the drive roller 82 than the holder 85 (upper end portions 85G, 85H) is from the drive roller 82. More specifically, the upper end surface 87A1 of the guide portion 87A is positioned below the upper end portion 85G, 85H of the holder 85, and extends in a direction parallel to the broken line H2. In FIG. 10B, the sheet S is on the way to the discharge opening 8A and the trailing end portion of the sheet S is in contact with the uppermost end A1 of the first pinch roller 83. Further, FIG. 10C illustrates a state immediately after the trailing end portion of the sheet S moves past the nip position N1 between the first pinch roller 83 and the drive roller 82.

In case of conveyance of the sheet S with low linearity, the first pinch roller 83 does not move to its separated position because of the low linearity of the sheet S and is maintained at its contact position. Therefore, the leading end portion of the sheet S first passes through the nip position N1, and the sheet S is conveyed in the discharging direction by the drive roller 82 and the first pinch roller 83. Thereafter, the leading end portion of the sheet S is brought into contact with the upper end portion 85G of the holder 85, passes through the nip position N2, and is conveyed toward downstream in the discharging direction by the drive roller 82 and the second pinch roller 84.

As illustrated in FIG. 10C, the trailing end portion of the sheet S is brought into contact with the upper end portion 85G of the holder 85 immediately after the trailing end moves past the nip position N1. While difference in level is provided between the line H1 passing through the uppermost end A1 of the first pinch roller 83 and the line H2 indicating the position of the upper end portion 85G of the holder 85, only a low or small impacting sound is generated by the collision of the trailing end portion of the sheet S against the upper end portion 85G of the holder 85 because of low linearity of the sheet S.

Next, operations for conveying the sheet S with high linearity will be described. A comparative example is illustrated in FIG. 11A where no guide portion 87A is provided, whereas the guide portion 87A is incorporated in the structure illustrated in FIGS. 11B and 11C.

Figure 11A:
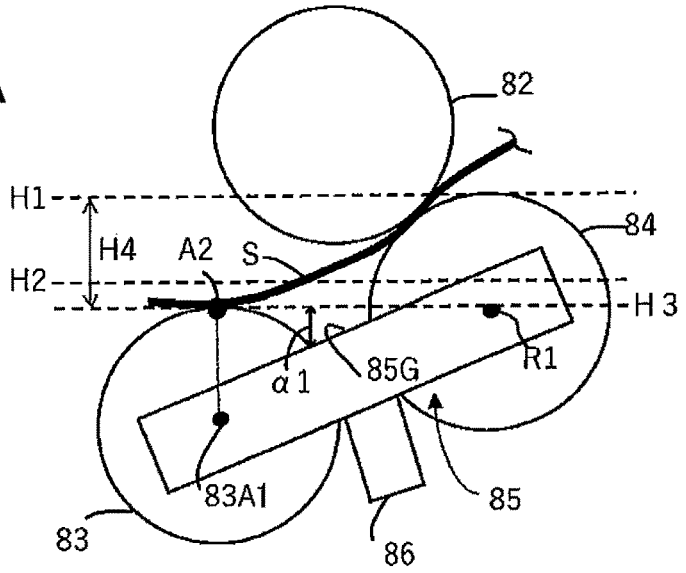
FIG. 11A is a simplified schematic diagram explaining how a sheet with high linearity is conveyed in a structure where no guide portion is provided as a comparative example.

In FIG. 11A, the first pinch roller 83 is separated from the drive roller 82 due to the strong linearity of the sheet S being conveyed. Here, A2 stands for an uppermost end of the outer peripheral surface of the first pinch roller 83 at its separated position. A broken line H3 stands for a line passing through the uppermost end A2 and perpendicular to a vertical line segment connecting the uppermost end A2 to the axis 83A1 of the roller shaft 83A. Further, "α1" stands for a largest distance from the upper end portion 85G of the holder 85 to the line H3. Incidentally, the uppermost end A2 of the first pinch roller 83 is now lowered to the position (A2) depicted in FIG. 11A from the position (A1) corresponding to the line H1 depicted in FIG. 10A. This amount of downward displacement of the first pinch roller 83 is indicated by "H4" in FIG. 11A. According to the depicted embodiment, the first pinch roller 83 moves downward by the displacement amount H4 in case of conveyance of the thick sheet S having high linearity. In other words, the uppermost end of the first pinch roller 83 can be separated farthest away from the drive roller 82 down to the position (A2) on the line H3. Hence, the displacement amount H4 will be referred to as a maximum displacement amount H4, hereinafter.

In FIG. 11A, the trailing end portion of sheet S having high linearity is in contact with the uppermost point A2 of the first pinch roller 83 at its separation position.

Figure 11B:
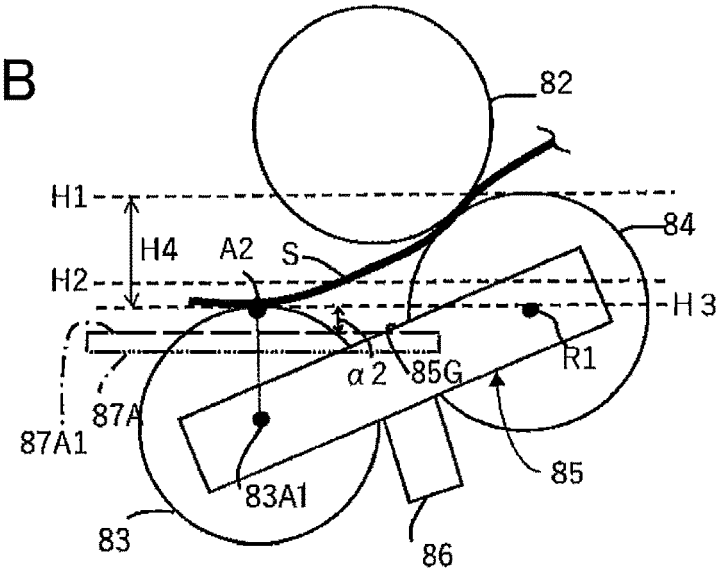
FIG. 11B is a simplified schematic diagram explaining how a sheet with high linearity is conveyed in a structure where a guide portion is provided in a horizontal orientation.

FIG. 11B illustrates an example where: the guide portion 87A is incorporated in the structure of FIG. 11A; the upper end surface 87A1 of the guide portion 87A is positioned below the line H3; and a portion of the upper end surface 87A1 is positioned above the upper end portion 85G of the holder 85. That is, the portion of the upper end surface 87A1 of the guide portion 87A is positioned closer to the drive roller 82 than a connecting portion of the holder 85 is to the drive roller 82, the connecting portion being a portion of the upper end portion 85G(85H) connecting the first pinch roller 83 and second pinch roller 84 and positioned between the first pinch roller 83 and second pinch roller 84. Here, "α2" stands for a distance between the line H3 and the portion of the upper end surface 87A1 of the guide portion 87A.

Assume that a sheet S with high linearity is conveyed in the comparative structure in FIG. 11A. The trailing end portion of the sheet S moves past the uppermost end A2 of the first pinch roller 83. After moving further downstream relative to the uppermost end A2 in the discharging direction, the trailing end portion of the sheet S is brought into abutment with the upper end portion 85G of the holder 85. Since there is the level difference al between the upper end portion 85G and the line H3, the trailing end portion falls down from the uppermost end A2 and collides with the upper end portion 85G of the holder 85 to generate collision sound.

In contrast, with the structure in FIG. 11B, the trailing end portion of the sheet S moves past the uppermost end A2 of the first pinch roller 83, and then the trailing end portion is brought into abutment with the upper end surface 87A1 of the guide portion 87A when the trailing end portion is conveyed further downstream in the discharging direction. Due to the level difference α2 between the upper end surface 87A1 and the line H3, the trailing end portion falls down from the uppermost end A2 and collides with the upper end surface 87A1 of the guide portion 87A to generate collision sound. However, since the distance α2 is shorter than the distance α1 (α1>α2), sound of collision in case of FIG. 11B with the guide member 87 is lower than that in case of FIG. 11A without the guide member 87. That is, provision of the guide member 87 can contribute to reduction of collision sound.

Figure 11C:
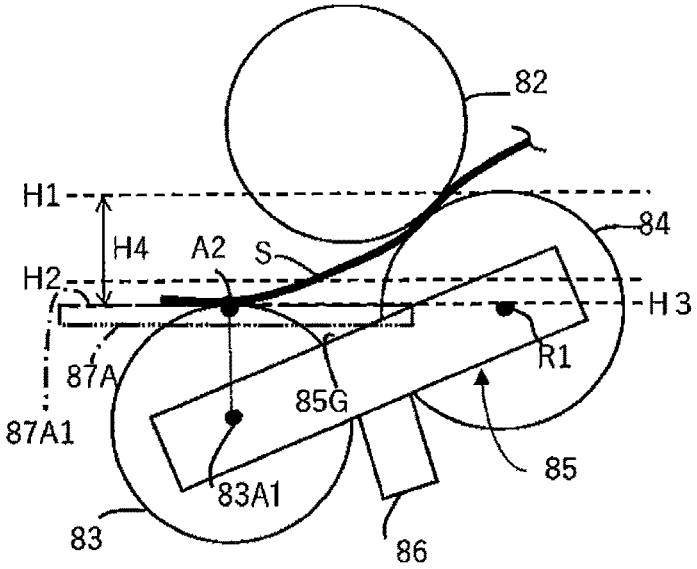
FIG. 11C is a simplified schematic diagram explaining how a sheet with high linearity is conveyed in a structure where a guide portion is provided in a horizontal orientation at a position higher than the position of FIG. 11B.

In an example illustrated in FIG. 11C, the upper end surface 87A1 of the guide portion 87A is arranged to be at the same height as the line H3. The trailing end portion of the sheet S moves past the uppermost end A2 of the first pinch roller 83, and then the trailing end portion is guided along the upper end surface 87A1 of the guide portion 87A without vertical displacement even when the trailing end portion is moved further downstream in the discharging direction. That is, since no level difference is provided between the uppermost end A2 and the upper end surface 87A1, hopping of the trailing end portion of the sheet S does not occur but the trailing end portion is smoothly transferred onto the upper end surface 87A1 from the uppermost end A2. Accordingly, generation of sound of collision is further suppressed between the trailing end portion of the sheet S and the upper end surface 87A1 of the guide portion 87A.

Figure 12A:
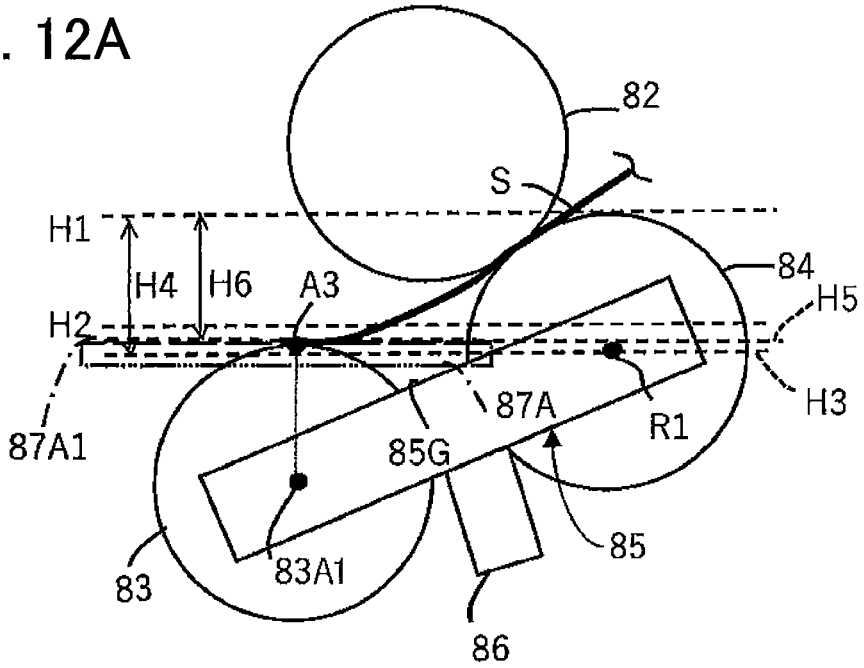
FIG. 12A is a simplified schematic diagram explaining how a sheet with high linearity is conveyed in a structure where a guide portion is provided in a horizontal orientation at a position higher than the position of FIG. 11C.

FIG. 12A illustrates another example where the upper end surface 87A1 of the guide portion 87A is positioned above the line H3, and above the upper end portion 85G of the holder 85. Specifically, the upper end surface 87A1 is positioned at a level equal to a line H5 which is positioned between the line H2 and the line H3 in the vertical direction.

In FIG. 12A, A3 represents an uppermost end of the first pinch roller 83. The uppermost end of the first pinch roller 83 is lowered to the position (A3) depicted in FIG. 12A from the position (A1) corresponding to the line H1 depicted in FIG. 10A. This amount of downward displacement of the first pinch roller 83 is indicated by "H6" in FIG. 12A. As described above, the uppermost end of the first pinch roller 83 should be able to move downward by the maximum displacement amount H4 to the position on the line H3 (A2 in FIG. 11A) when the sheet S with high linearity is to be conveyed. However, according to the structure of FIG. 12A, since the upper end surface 87A1 of the guide portion 87A is positioned at the same height as the line H5, the uppermost end A3 of the first pinch roller 83 is moved down to the position on the line H5 which is higher than the line H3.

With this structure of FIG. 12A, since the displacement amount H6 is smaller than the maximum displacement amount H4, the trailing end portion of the sheet S can be guided smoothly onto the upper end surface 87A1 of the guide portion 87A from the uppermost end A3, as in the structure of FIG. 11C. This structure can also suppress generation of collision sound between the trailing end portion of the sheet S and the upper end surface 87A1 of the guide portion 87A.

Further, since the displacement amount H6 of the first pinch roller 83 in FIG. 12A is smaller than the maximum displacement amount H4 of the first pinch roller 83 in FIG. 11C, the structure of FIG. 12A can also reduce generation of collision sound that may occur as a result of abutment of the first pinch roller 83 against the drive roller 82 when the first pinch roller 83 is returned from the separated position to the contact position.

Figure 12B:
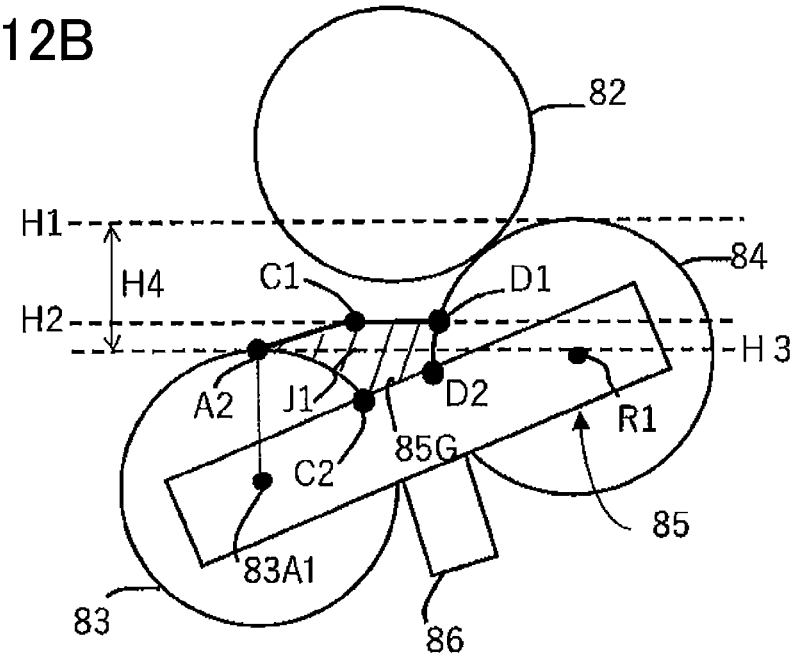
FIG. 12B is a simplified schematic diagram explaining how a sheet with high linearity is conveyed and illustrating a possible range in which an upper end surface of the guide portion can be positioned.

FIG. 12B illustrates a possible range in which the upper end surface 87A1 of the guide portion 87A may be arranged. As in the example of FIG. 11A, the uppermost end A2 of the first pinch roller 83 is moved downward by the maximum displacement amount H4 to be positioned at the line H3, because of high linearity of the sheet S.

The upper end surface 87A1 of the guide portion 87A can be positioned within a hatched region J1 enclosed by a plurality of line segments including: (a) a straight line segment (first line segment) connecting an intersection point C1 and an intersection point D1; (b) a curved line segment along the outer peripheral surface of the second pinch roller 84 and extending from the point D1 to an intersection point D2; (c) a straight line segment (second line segment) along the upper end portion 85G and connecting the intersection point D2 and an intersection point C2; (d) a curved line segment along the outer peripheral surface of the first pinch roller 83 and extending from the intersection point C2 to the uppermost end A2 of the first pinch roller 83; and (e) a straight line segment (third line segment) connecting the uppermost end A2 and the intersection point C1.

Here, C1 is the intersection point identical to the point C1 in FIG. 10A. That is, the point C1 stands for the intersection point between the upper end portion 85G of the holder 85 and the outer peripheral surface of the first pinch roller 83 when the uppermost end A1 of the first pinch roller 83 is positioned at the line H1. The point D1 is the intersection point identical to the point D1 in FIG. 10A. That is, the point D1 stands for the intersection point between the upper end portion 85G of the holder 85 and the outer peripheral surface of the second pinch roller 84 when the uppermost end A1 of the first pinch roller 83 is located at the line H1. The point D2 stands for an intersection point between the upper end portion 85G of the holder 85 and the outer peripheral surface of the second pinch roller 84 when the uppermost end A2 of the first pinch roller 83 is located at the line H3. The point C2 stands for an intersection point between the upper end portion 85G of the holder 85 and the outer peripheral surface of the first pinch roller 83 when the uppermost end A2 of the first pinch roller 83 is located at the line H3.

Figure 13A:
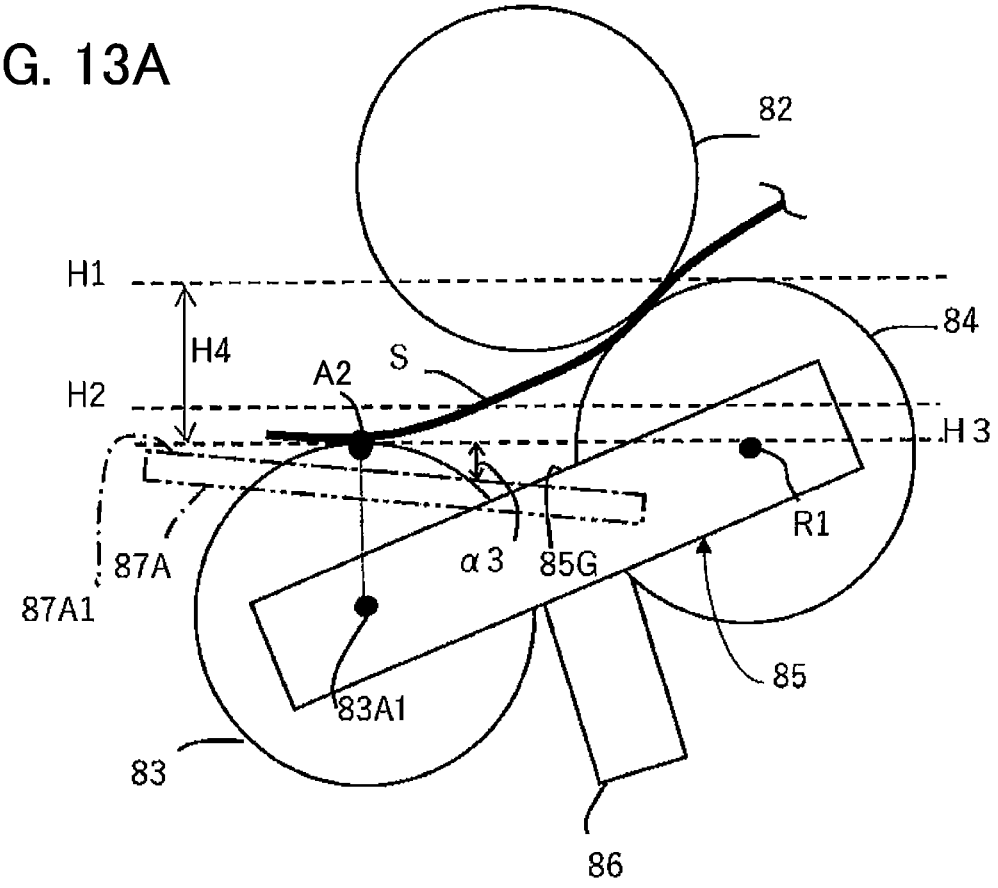
FIG. 13A is a simplified schematic diagram explaining how a sheet with high linearity is conveyed in a structure where a guide portion is provided in a slanted orientation, wherein an upper end surface of the guide portion is positioned below an uppermost end of the first pinch roller.

FIG. 13A illustrates an example where the upper end surface 87A1 of the guide portion 87A is sloped downward in a direction from the first pinch roller 83 to the second pinch roller 84, and the upper end surface 87A1 is positioned below the line H3. In FIG. 13A, "α3" represents a distance from the line H3 to the sloped upper end 87A1. More specifically, the distance α3 is a distance from the line H3 to a point on the sloped upper end 87A1, the point being positioned in a range from an intersection point between the upper end 87A1 and the outer peripheral surface of the first pinch roller 83, to an intersection between the upper end 87A1 and the upper end portion 85G. Due to this level difference "α3" between the line H3 (uppermost end A2) and upper end 87A1, collision noise may be generated, as in the structure of FIG. 11B. However, generated collision noise may be smaller than a noise which may be generated in a structure where the guide portion 87A is not provided, since the distance α3 is smaller than the distance al shown in FIG. 11A. Therefore, the example in FIG. 13A can also reduce generation of collision noise.

Figure 13B:
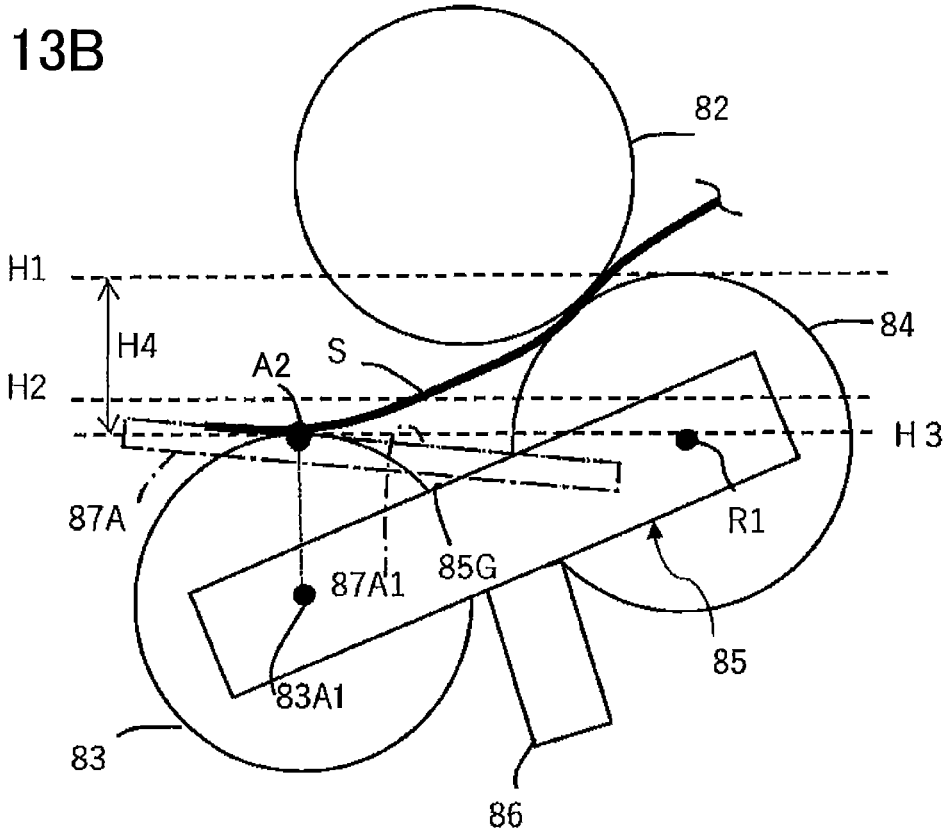
FIG. 13B is a simplified schematic diagram explaining how a sheet with high linearity is conveyed in a structure where a guide portion is provided in a slanted orientation, wherein an upper end surface of the guide portion is positioned at the same height as the uppermost end of the first pinch roller.

FIG. 13B illustrates still another example where the upper end surface 87A1 of the guide portion 87A is inclined downward in the direction from the first pinch roller 83 to the second pinch roller 84 but the upper end surface 87A1 is arranged to pass through the uppermost end A2 of the first pinch roller 83. Similar to the example illustrated in FIG. 11C, the trailing end portion of the sheet S is smoothly guided without hopping and transferred onto the upper end surface 87A1 of the guide portion 87A from the uppermost end A2 of the first pinch roller 8, since there is no level difference between the uppermost end A2 and the upper end surface 87A1. Accordingly, generation of collision noise can be further reduced.

Further, the structure where the upper end surface 87A1 is inclined diagonally downward (as in FIGS. 13A and 13B) can provide a region greater than a region provided by the structure where the upper end surface 87A1 extends horizontally (as in FIGS. 11B and 11C), the region being a space surrounded by the drive roller 82, the first pinch roller 83, the second pinch roller 84 and the upper end surface 87A1 of the guide portion 87A. Therefore, diagonally downward inclination of the upper end surface 87A1 can provide a wider region to allow the sheet S to be largely deformed.

<Operational and Technical Advantages of the Embodiment>

According to the structure of present embodiment, in a case where the sheet S with strong linearity is to be conveyed, the first pinch roller 83 is moved to the separated position by the linearity of the sheet S and the sheet S is conveyed along the outer peripheral surface of the first pinch roller 83 and/or the guide portion 87A of each guide member 87. The level difference between the uppermost end A2 of the first pinch roller 83 and the guide portion 87A can be smaller than the level difference between the uppermost end A2 and the upper end portion 85G, 85H of the holder 85 in case of the configuration where the guide portion 87A is not provided (see FIG. 11A). That is, the sheet S can be conveyed onto the guide member 87 with a smaller level difference. Accordingly, generation of collision noise can be suppressed. Also, hopping of the trailing end portion of the sheet S can be made smaller, thereby contributing to stable conveyance of the trailing end portion.

In the present embodiment, the first pinch roller 83 is allowed to displace downward to the separated position by the strong linearity of the sheet S conveyed by the drive roller 82. Hence, the trailing end portion of the sheet S can be transferred onto the upper end surface 87A1 of the guide portion 87A from the uppermost end A2 of the first pinch roller 83 without a vertical gap therebetween. With this structure, leaping of the trailing end portion of the sheet S can be suppressed, and generation of collision noise can be reduced.

In the present embodiment, the second pinch roller 84 is rotatably supported by the housing 2, whereas the first pinch roller 83 is pivotably supported by the holder 85 about the first axis R1 of the roller shaft 84A. That is, the second pinch roller 84 does not separate from the drive roller 82.

With this structure, compared to a structure where both of the first pinch roller 83 and second pinch roller 84 are able to separate from the drive roller 82, the discharging direction of the sheet S can be stabilized; and the first pinch roller 83 is less likely to generate collision sound when the first pinch roller 83 is returned from the separated position to the contact position and abuts against the drive roller 82.

In the embodiment, the pair of guide members 87 is positioned one beside each axial end portion of the first pinch roller 83. With this structure, since widthwise ends of the sheet S can be guided by the respective guide members 87, stable conveyance of the sheet S can be realized.

In the present embodiment, in the state where the first pinch roller 83 and the second pinch roller 84 are both in contact with the drive roller 82 (i.e., in the state where the first pinch roller 83 is at the contact position), the connection portion of the holder 85 can contact the leading end portion of the sheet S discharged by the drive roller 82 to guide the leading end portion toward the second pinch roller 84.

With this structure, since the leading end portion of the conveyed sheet S is guided by the connecting portion of the holder 85 (portions of the upper end portions 85G, 85H), the leading end portion can be smoothly conveyed toward the second pinch roller 84 without colliding against other parts and components.

In the present embodiment, the diameter of the first pinch roller 83 is smaller than the diameter of the second pinch roller 84. Therefore, a range of displacement of the first pinch roller 83 can be reduced to make the sheet discharging unit 8 compact.

<Variations and Modifications>

Figure 14:
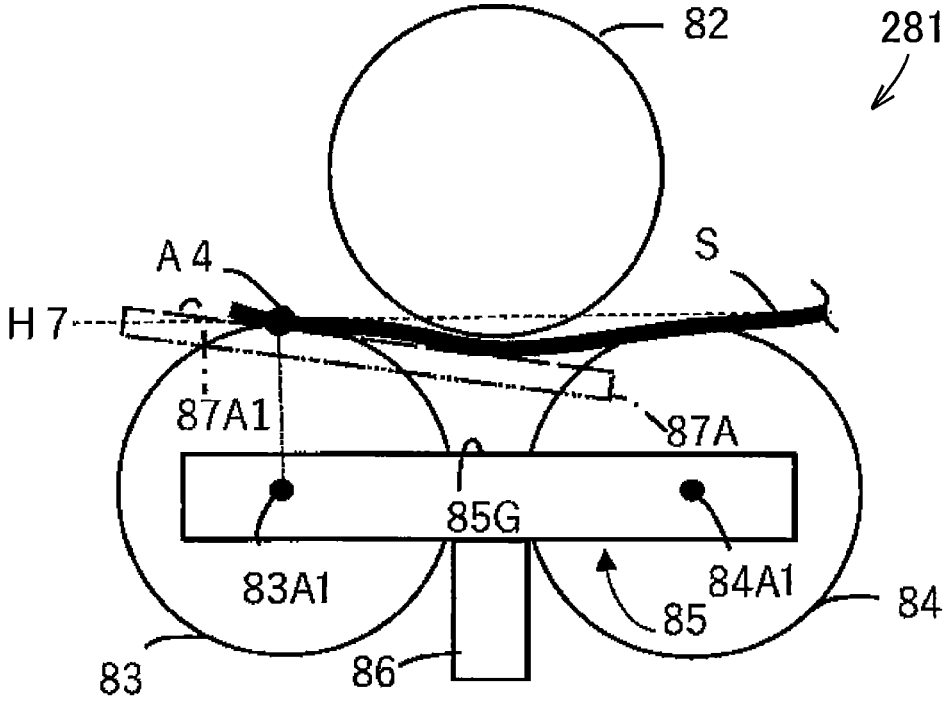
FIG. 14 is a simplified schematic diagram illustrating a discharge mechanism according to a variation of the embodiment, in which a first pinch roller and a second pinch roller are integrally movable.

FIG. 14 illustrates a discharge mechanism 281 according to a variation of the embodiment.

According to the structures of the embodiment and examples illustrated in FIGS. 10A through 13B, the roller shaft 84A of the second pinch roller 84 is rotatably supported by the housing 2, so that the second pinch roller 84 is rotatable about the first axis R1. On the other hand, in the structure of FIG. 14, the roller shaft 84A of the second pinch roller 84 is not supported by the housing 2 but is rotatably supported by the holder 85. The second pinch roller 84 of this variation is rotatable about an axis 84A1 of the roller shaft 84A.

Specifically, FIG. 14 illustrates a state where the trailing end portion of the thick sheet S is in contact with an uppermost end A4 of the first pinch roller 83, and the first pinch roller 83 is separated from the drive roller 82 due to the strong linearity of the sheet S. A line H7 stands for a line passing through the uppermost end A4 and extending perpendicular to a line segment connecting the uppermost end A4 and the axis 83A1 of the roller shaft 83A.

In FIG. 14, the upper end surface 87A1 of the guide portion 87A is sloped diagonally downward in the discharging direction, and the upper end surface 87A1 has a portion coincident with the uppermost end A4 in the vertical direction. The trailing end portion of the sheet S moves past the uppermost end A4 of the first pinch roller 83, and is then guided by the upper end surface 87A1 while maintaining contact therewith even after the trailing end is conveyed downstream of the uppermost end A4 in the discharging direction. Since there is no level difference between the uppermost end A4 and the upper end surface 87A1, the trailing end portion of the sheet S can be smoothly guided along the upper end surface 87A1 without hopping. Hence, collision sound due to abutment of the trailing end portion of the sheet S against the upper end surface 87A1 of the guide portion 87A can be reduced or does not occur.

Other modifications and variations are also conceivable.

For example, in the discharge mechanism 81 of the depicted embodiment, a vertical positional relationship between the drive roller 82 and the holder 85 may be reversed. That is, the drive roller 82 may be positioned below the first pinch roller 83 and the second pinch roller 84. Such an arrangement may be employed to correct a downwardly-protruding sheet curling, which is contrary to the upwardly-protruding sheet curling that the discharge mechanism 81 of the embodiment intends to correct.

According to the foregoing embodiment, the first pinch roller 83 is supported by the holder 85, and the urging member 86 urges the holder 85. Alternatively, for example, the first pinch roller 83 may be provided with a bearing portion, and the urging member 86 may be interposed between the bearing portion and the holder 85 so that the urging member 86 urges the bearing portion. In the latter case, the holder 85 may support the roller shaft 83A of the first pinch roller 83 and the roller shaft 84A of the second pinch roller 84.

According to the depicted embodiment, a single urging member (the urging member 86) is provided. However, two or more urging members may be provided.

According to the foregoing embodiment, the first pinch roller 83 and the second pinch roller 84 are follower rollers rotatable by the rotation of the drive roller 82. However, as a modification, the first pinch roller 83 and the second pinch roller 84 may be drive rollers, respectively.

According to the foregoing embodiment, the sheet discharging unit 8 is assembled in the electrophotographic type image-forming apparatus 1. However, the sheet discharging unit 8 may be incorporated in an image-forming apparatus of a different type, such as an ink-jet printer, or may be incorporated in an image-processing device such as an image-reading device configured to read an image of an original document.

According to the foregoing embodiment, the upper end portions 85G, 85H of the holder 85 are positioned above an imaginary line connecting the axis 83A1 of the roller shaft 83A and the first axis R1 of the roller shaft 84A. That is, the upper end portions 85G and the upper end portion 85H are positioned closer to the drive roller 82 than the imaginary line is to the drive roller 82. However, other structures are also available. For example, the holder 85 may have a U-shape so that the holder 85 may have a downwardly convex shape. In the latter case, the upper end portion 85G and the upper end portion 85H may be positioned below the imaginary line.

While the description has been made in detail with reference to the embodiments thereof, it would be apparent to those skilled in the art that many modifications and variations may be made therein without departing from the scope of the disclosure.

[Remarks]

The sheet discharging unit 8 is an example of a sheet discharging device of the disclosure. The image-forming unit 5 is an example of an image-processing unit. The image-forming apparatus 1 is an example of an image-processing apparatus. The housing 2 is an example of a housing. The drive roller 82 is an example of a drive roller. The first pinch roller 83 is an example of a first pinch roller. The second pinch roller 84 is an example of a second pinch roller. The holder 85 is an example of a holder. The portions of the upper end portions 85G, 85H positioned between the first pinch roller 83 and the second pinch roller 84 are an example of a connecting portion of the holder. The urging member 86 is an example of an urging member. The guide member 87 (guide portion 87A) is an example of a guide member. The upper end surface 87A1 of the guide portion 87A is an example of a sheet contact portion. An upper surface of the guide portion 87A is an example of a sloped surface. The intersection point C1 is an example of a first intersection point C1. The intersection point D1 is an example of a second intersection point. The intersection point D2 is an example of a third intersection point. The intersection point C2 is an example of a fourth intersection point. The uppermost end A2 of the first pinch roller 83 is an example of a fifth intersection point. The region J1 is an example of a region. The axis 83A1 is an example of a rotation axis of the first pinch roller. The first axis R1 is an example of a rotation axis of the second pinch roller.

What is claimed is:

1. A sheet discharging device comprising:

a housing;

a drive roller disposed in the housing and configured to discharge a sheet in a discharging direction;

a first pinch roller disposed to face the drive roller and configured to contact the drive roller for rotation;

a second pinch roller rotatable about a first axis and disposed downstream relative to the first pinch roller in the discharging direction, wherein the second pinch roller faces the drive roller and is in contact with the drive roller for rotation, and wherein the second pinch roller is immovable relative to the drive roller;

a holder pivotably movable about the first axis with respect to the housing and including a connecting portion supporting the first pinch roller and the second pinch roller, the holder supporting the first pinch roller to allow the first pinch roller to move between a contact position where the first pinch roller is in contact with the drive roller and a separated position where the first pinch roller is separated from the drive roller;

an urging member configured to urge the first pinch roller toward the drive roller; and a guide member provided at a predetermined position between the first pinch roller and the second pinch roller in the discharging direction, wherein, when the first pinch roller is at the contact position, the guide member is positioned farther away from the drive roller than the connecting portion of the holder is, and wherein, when the first pinch roller is at the separated position against an urging force of the urging member, the guide member is positioned closer to the drive roller than the connecting portion of the holder is.

2. The sheet discharging device according to claim 1, wherein the guide member includes a sheet contact portion configured to contact an end portion in the discharging direction of the sheet discharged by the drive roller;

wherein the first pinch roller protrudes further relative to the sheet contact portion toward the drive roller when the first pinch roller is at the contact position; and wherein the first pinch roller has an outer peripheral surface, the first pinch roller having a portion nearest to the drive roller on the outer peripheral surface, the nearest portion of the outer peripheral surface being at the same height as the sheet contact portion when the first pinch roller is at the separated position.

3. The sheet discharging device according to claim 2, wherein the holder is configured to support the first pinch roller such that the first pinch roller at the separated position is separated away from the first pinch roller by a maximum separation amount to be at a maximum separated position; and wherein the sheet contact portion of the guide member is positioned closer to the drive roller than the nearest portion is to the drive roller when the first pinch roller is at the maximum separated position.

4. The sheet discharging device according to claim 1, wherein the second pinch roller is supported by the housing and is rotatable about athe first axis; and wherein the first pinch roller is pivotally movable about the first axis.

5. The sheet discharging device according to claim 1, wherein the guide member has a sloped surface sloping away from the drive roller toward downstream in the discharging direction from the first pinch roller to the second pinch roller.

6. The sheet discharging device according to claim 1, wherein the guide member is positioned at each end portion in an axial direction of the first pinch roller.

7. The sheet discharging device according to claim 1, wherein the connecting portion of the holder is configured to contact a leading end portion of the sheet discharged from the drive roller to guide the leading end portion toward the second pinch roller when the first pinch roller is at the contact position and the second pinch roller is in contact with the drive roller.

8. The sheet discharging device according to claim 1, wherein the predetermined position is positioned within a region defined by a plurality of line segments including:

(a) a first line segment which is a straight line connecting a first intersection point and a second intersection point, the first intersection point being an intersection between an edge of the connecting portion of the holder and a first part of an outer peripheral surface of the first pinch roller when the first pinch roller is at the contact position, the edge facing the drive roller, the second intersection point being an intersection between the edge of the connecting portion of the holder and a second part of an outer peripheral surface of the second pinch roller when the first pinch roller is at the contact position, the first part of the outer peripheral surface and the second part of the outer peripheral surface facing each other;

(b) a first curved line segment along the outer peripheral surface of the second pinch roller and extending from the second intersection point to a third intersection point, the third intersection point being an intersection between the edge of the connecting portion of the holder and a third part of the outer peripheral surface of the second pinch roller when the first pinch roller is at the separated position;

(c) a second line segment which is a straight line on and along the edge of the connecting portion of the holder and connecting the third intersection point to a fourth intersection point, the fourth intersection point being an intersection between the edge of the connecting portion of the holder and a fourth part of the outer peripheral surface of the first pinch roller when the first pinch roller is at the separated position, the fourth part facing the third part of the outer peripheral surface of the second pinch roller;

(d) a second curved line segment on and along the outer peripheral surface of the first pinch roller and extending from the fourth intersection point to a fifth intersection point facing the drive roller, the fifth intersection point being an intersection between the outer peripheral surface of the first pinch roller and a line passing through a rotation axis of the first pinch roller and perpendicular to the first line segment; and (e) a third straight line segment connecting the fifth intersection point to the first intersection point.

9. The sheet discharging device according to claim 1, wherein the first pinch roller has a diameter smaller than a diameter of the second pinch roller.

10. An image-processing apparatus comprising:

the sheet discharging device according to claim 1; and an image-processing unit configured to form an image on the sheet, the image-processing unit being disposed in the housing at a position upstream relative to the sheet discharging device in the discharging direction.

11. A sheet discharging device comprising:

a housing;

a drive roller disposed in the housing and configured to discharge a sheet in a discharging direction;

a first pinch roller disposed to face the drive roller and configured to contact the drive roller for rotation;

a second pinch roller disposed downstream relative to the first pinch roller in the discharging direction, the second pinch roller being configured to face the drive roller and contact the drive roller for rotation;

a holder including a connecting portion supporting the first pinch roller and the second pinch roller, the holder supporting the first pinch roller to allow the first pinch roller to move between a contact position where the first pinch roller is in contact with the drive roller and a separated position where the first pinch roller is separated from the drive roller;

an urging member configured to urge the first pinch roller toward the drive roller; and a guide member provided at a predetermined position, the guide member being separated from the sheet discharged from the drive roller when the first pinch roller is at the contact position, the guide member being configured to contact the sheet discharged from the drive roller to guide the sheet when the first pinch roller is at the separated position, wherein, in a state where the first pinch roller is at the contact position and the second pinch roller is in contact with the drive roller, a part of the guide member is positioned within a space defined between a first part of an outer peripheral surface of the first pinch roller and a second part of an outer peripheral surface of the second pinch roller, the first part and the second part facing each other; and wherein, when the first pinch roller is at the contact position, the guide member is positioned farther away from the drive roller than the connecting portion of the holder is, and wherein, when the first pinch roller is at the separated position against an urging force of the urging member, the guide member is positioned closer to the drive roller than the connecting portion of the holder is.

12. A sheet discharging device comprising:

a housing;

a drive roller disposed in the housing and configured to discharge a sheet in a discharging direction;

a first pinch roller disposed to face the drive roller and contactable with the drive roller for rotation;

a second pinch roller rotatable about a first axis and disposed downstream relative to the first pinch roller in the discharging direction, wherein the second pinch roller faces the drive roller and is in contact with the drive roller for rotation, and wherein the second pinch roller is immovable relative to the drive roller;

a holder pivotably movable about the first axis with respect to the housing and supporting the first pinch roller and the second pinch roller, the holder supporting the first pinch roller to allow the first pinch roller to move between a contact position where the first pinch roller is in contact with the drive roller and a separated position where the first pinch roller is separated from the drive roller;

an urging member configured to urge the first pinch roller toward the drive roller; and a guide member provided at a predetermined position, the guide member being separated from the sheet discharged from the drive roller when the first pinch roller is at the contact position, the guide member being configured to contact the sheet discharged from the drive roller to guide the sheet when the first pinch roller is at the separated position, wherein, in a state where the first pinch roller is at the contact position and the second pinch roller is in contact with the drive roller, the predetermined position is within a space defined by:

a first part of an outer peripheral surface of the first pinch roller;

a second part of an outer peripheral surface of the second pinch roller, the first part and the second part facing with each other; and an imaginary line connecting a rotation axis of the first pinch roller and a rotation axis of the second pinch roller.

* * * * *